US009076357B2

(12) United States Patent
Hussain et al.

(10) Patent No.: US 9,076,357 B2
(45) Date of Patent: Jul. 7, 2015

(54) REDUNDANT OPERATION OF A BACKLIGHT UNIT OF A DISPLAY DEVICE UNDER A SHORTED LED CONDITION

(71) Applicant: APPLE INC., Cupertino, CA (US)

(72) Inventors: Asif Hussain, San Jose, CA (US); Manisha P. Pandya, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 182 days.

(21) Appl. No.: 13/679,745

(22) Filed: Nov. 16, 2012

(65) Prior Publication Data

US 2014/0139499 A1 May 22, 2014

(51) Int. Cl.

| | |
|---|---|
| ***G09G 3/36*** | (2006.01) |
| ***G09G 5/00*** | (2006.01) |
| ***H05B 33/08*** | (2006.01) |
| ***G09G 3/34*** | (2006.01) |

(52) U.S. Cl.

CPC ..... *G09G 5/00* (2013.01); *H05B 33/0827* (2013.01); *H05B 33/0893* (2013.01); *G09G 3/3406* (2013.01); *G09G 2300/0426* (2013.01); *G09G 2330/04* (2013.01); *G09G 2330/08* (2013.01); *G09G 2310/0264* (2013.01)

(58) Field of Classification Search

CPC . G09G 5/00; G09G 2300/04; G09G 2300/08; G09G 2310/0264; G09G 2320/0233; G09G 2320/0626; H05B 33/0824; H05B 33/0827; H05B 33/0893

USPC ..... 345/102, 204; 315/121–123, 291–311

See application file for complete search history.

(56) References Cited

U.S. PATENT DOCUMENTS

| | | | | |
|---|---|---|---|---|
| 6,521,879 | B1 * | 2/2003 | Rand et al. | 250/205 |
| 7,548,030 | B2 | 6/2009 | Korcharz et al. | |
| 7,629,751 | B2 * | 12/2009 | Chou et al. | 315/123 |
| 7,696,964 | B2 | 4/2010 | Lankhorst et al. | |
| 7,710,253 | B1 * | 5/2010 | Fredricks | 340/464 |
| 7,800,876 | B2 * | 9/2010 | Peker et al. | 361/86 |
| 7,847,783 | B2 * | 12/2010 | Liu et al. | 345/102 |
| 7,999,785 | B2 * | 8/2011 | Ye et al. | 345/102 |
| 8,189,313 | B1 * | 5/2012 | Kraft | 361/93.1 |
| 8,334,662 | B2 * | 12/2012 | Jin et al. | 315/299 |
| 8,363,004 | B2 * | 1/2013 | Ye et al. | 345/102 |
| 8,471,483 | B2 * | 6/2013 | Lee et al. | 315/192 |
| 2007/0115228 | A1 | 5/2007 | Roberts et al. | |

(Continued)

FOREIGN PATENT DOCUMENTS

WO 2011011548 A1 1/2011

*Primary Examiner* — Rodney Amadiz
(74) *Attorney, Agent, or Firm* — Fletcher Yoder PC

(57) ABSTRACT

Disclosed embodiments relate to techniques for operating a backlight unit of a display device in a redundant mode and a non-redundant mode in the event of a shorted LED failure condition. For instance, in a redundant mode, multiple LED strings arranged in an end-to-end configuration are each driven to provide a first quantity of light, such that the combined output from all LED strings is capable of providing a total light output corresponding to a maximum brightness setting for the display device. In the case that an LED on one of the strings fails due to a shorted LED failure condition, the remaining functional LEDs of the affected string may be driven to provide a second quantity of light, such that the combined output from the affected strings and the non-affected strings may still provide the same total light output for achieving the maximum brightness setting. The second quantity of light is greater than the first quantity.

21 Claims, 15 Drawing Sheets

(56) References Cited

U.S. PATENT DOCUMENTS

| | | | | |
|---|---|---|---|---|
| 2007/0159750 | A1* | 7/2007 | Peker et al. | 361/93.1 |
| 2008/0100561 | A1* | 5/2008 | Price et al. | 345/102 |
| 2009/0040153 | A1 | 2/2009 | Scheibe | |
| 2009/0051629 | A1 | 2/2009 | Price et al. | |
| 2009/0189842 | A1 | 7/2009 | Huang et al. | |
| 2010/0072901 | A1 | 3/2010 | De Rijck et al. | |
| 2010/0085295 | A1 | 4/2010 | Zhao et al. | |
| 2010/0244701 | A1 | 9/2010 | Chen et al. | |
| 2011/0001432 | A1* | 1/2011 | Chung et al. | 315/152 |
| 2012/0162968 | A1* | 6/2012 | Messmer | 362/97.1 |
| 2013/0088171 | A1* | 4/2013 | Fensore | 315/307 |

* cited by examiner

REDUNDANT OPERATION OF A BACKLIGHT UNIT OF A DISPLAY DEVICE UNDER A SHORTED LED CONDITION

BACKGROUND

The present disclosure relates generally to backlight units used as an illumination source for a display device and, more specifically, to backlight units having light-emitting elements being configured to provide a degree of redundancy in the event that one or more of the light-emitting elements malfunctions during operation.

This section is intended to introduce the reader to various aspects of art that may be related to various aspects of the subject matter described and/or claimed below. This discussion is believed to be helpful in providing the reader with background information to facilitate a better understanding of the various aspects of the present disclosure. Accordingly, it should be understood that these statements are to be read in this light, not as admissions of prior art.

Electronic devices increasingly include display devices to provide visual feedback as part of a user interface. For instance, display devices may display various images associated with the operation of the electronic device, including photographs, video, text (e.g., a document, a webpage, or an e-mail, etc.), as well as images associated with a graphical user interface (e.g., icons, windows, screens, etc.) of the electronic device. As may be appreciated, display devices may be employed in a wide variety of electronic devices, such as desktop computer systems, laptop computers, and handheld computing devices, such as cellular telephones and portable media players. In particular, liquid crystal display (LCD) panels have become increasingly popular for use in display devices, due at least in part to their light weight and thin profile, as well as the relatively low amount of power required for operation.

However, because an LCD does not emit or produce light on its own, a backlight unit is typically provided in conjunction with the LCD panel as part of the display device in order to produce a visible image. A backlight unit typically provides backlight illumination by supplying light emitted from one or more light-emitting elements (a light source) to the LCD panel. Light-emitting elements commonly used in backlight units may include cold cathode fluorescent lamps (CCFLs) or light emitting diodes (LEDs). For example, backlight units utilizing LEDs may include one or more groups of LEDs, referred to sometimes as strings.

It is generally inevitable that a percentage of manufactured LCDs may become defective during their operational lifetime due, for example, to one or more of the light-emitting elements of the backlight unit malfunctioning. When this occurs, the affected light-emitting elements may become inoperable and cease emitting light, thus reducing the amount of light that may be provided by the backlight unit. From the perspective of a user, this may result in a noticeable reduction in the brightness in some parts or all of the screen of the LCD, which may cause images displayed on the screen to appear dimmer than intended or, in some cases, completely unperceivable, such as in a scenario in which all of the light-emitting elements of the backlight malfunction. Unfortunately, it is generally difficult and sometimes cost-prohibitive to repair LCDs in the event of such a malfunction.

There are currently two ways to make white light with LEDs: one method uses multiple wavelengths from different LEDs to make white light (e.g., a red LED, a green LED, and a blue LED), and the second method uses a white LED (e.g., a blue Indium-Galium-Nitride (InGaN) LED with a phosphor coating which creates white light). With regard to the second method, most manufacturers of high-power white LEDs estimate a lifetime of around 30,000 hours at the 70% lumen maintenance level, assuming maintaining junction temperature at no higher than 90 degrees Fahrenheit. Therefore, white LED failures may occur when LED junction temperature rises above this temperature.

LED backlighting employs different schemes—one of which is an edge lit scheme. In an edge lit scheme, a light bar (or light source) may be mounted along an edge of the display to deliver light into a light guide that diffuses light evenly across the display. This edge lit scheme has its advantages in terms of cost, compactness and very flat modular construction of the backlight. However, when a string of LEDs is used to deliver light into the light guide, some additional space (sometimes referred to as "mixing distance") is used to allow for light from the individual LEDs to diffuse or mix, and this mixing distance usually depends on the distance between adjacent LEDs. Beyond this mixing area, homogeneous or mixed light is available for illuminating the display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with one aspect of the present disclosure, systems, devices, and methods relating to the operation of a backlight unit of a display device in the event that single or multiple LEDs in an LED string fail are provided. For example, one or more LEDs in the LED string may experience a short circuit failure. The backlight may be configured to operate in both a redundant mode and a non-redundant mode to address single or multiple LED short circuit failures. For instance, in a redundant mode, multiple LED strings arranged in an end-to-end configuration may each be driven to provide a first quantity of light, such that the combined output from all LED strings provides a total light output that corresponds to a maximum brightness setting for the display device. In the event that one or more LEDs on one of the strings fails, the remaining functional LEDs of the affected and/or non-affected strings may be driven to provide a second quantity of light, such that the combined output from the affected strings and the non-affected strings may still provide the same total light output for achieving the maximum brightness setting for the display device.

In accordance with another aspect of the present disclosure, systems, devices, and methods relating to the operation of a backlight of a display device in the event that a condition causes an entire LED string to fail are provided. For example, if an open circuit occurs in an LED string, the entire LED string will fail. As another example, if several LEDs in a string experience short circuits, the entire LED string may fail and be turned off. In one embodiment, the backlight may be configured to operate in a redundant mode and a non-redundant mode of operation to address such LED string failures. For instance, in a redundant mode, multiple LED strings are driven to provide a first quantity of light, such that the collective output from all LED strings is capable of providing a luminance output that corresponds to a maximum front-of-screen brightness setting for the display device. In the case that one of the LED strings fails entirely, due to an open circuit or multiple short circuit LED string condition (i.e., a shorted LED string condition) for example, the remaining LED strings may be driven to provide a second quantity of light that is greater than the first quantity, such that the combined light output from the remaining LED strings is still capable of providing the same luminance output for achieving the maximum brightness setting for the display device.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments of the present disclosure are described below. These embodiments are only examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are be made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features.

The present disclosure relates generally to techniques for implementing a backlight unit of a display device to provide for both redundant and non-redundant modes of operation. Particularly these techniques allow for a backlight unit to continue to operate to provide an expected level of front-of-screen (FOS) brightness for the display, even if one or more LEDs or LED strings fail or malfunction, due to open circuit and/or short circuit conditions for example. The present techniques allow for the backlight to seamlessly switch between operating modes such that, in the event of an open circuit/short circuit failure, the backlight continues to operate and provide an expected light output with the failure being unperceivable by the viewer. Providing such a level a redundant/non-redundant operation in a backlight unit of a display may at least partially address some of the inconveniences associated with the need to repair and/or replace a conventional display due to the failure of a light source within the backlight unit and, therefore, increases the overall product life time.

Figure 1:
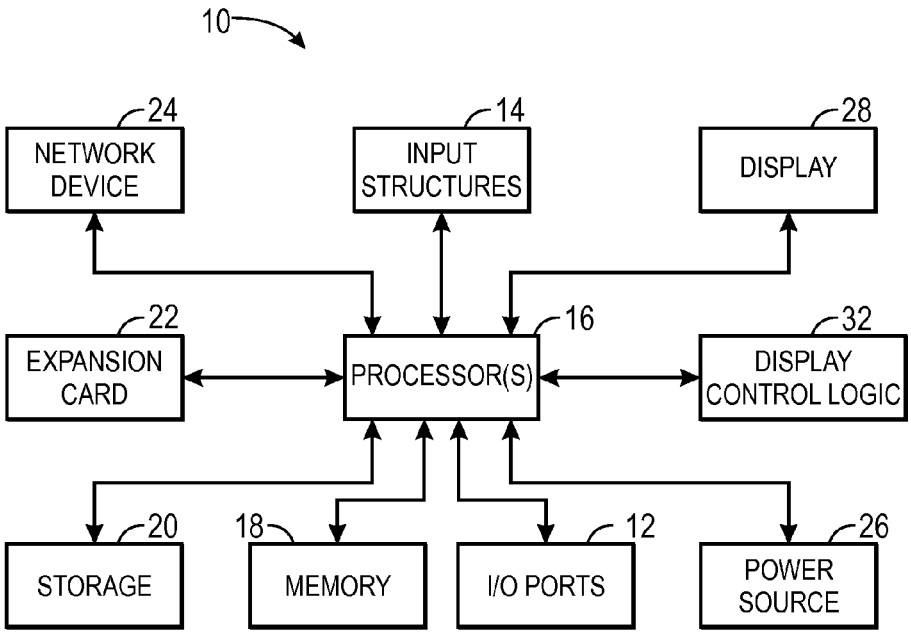
FIG. 1 is a simplified block diagram depicting components of an example of an electronic device that includes a display device having a backlight unit with light-emitting elements configured to operate in a redundant mode and a non-redundant mode, in accordance with aspects set forth in the present disclosure.

With the foregoing points in mind, FIG. 1 provides a block diagram illustrating an example of an electronic device 10 that may incorporate aspects of the present disclosure. The electronic device 10 may be any type of device that incorporates a display, such as a laptop or desktop computing device, a mobile phone, a digital media player, and so forth. As shown in FIG. 1, the electronic device 10 may include various internal and/or external components contributing to the function of the device 10. For instance, the various functional blocks shown in FIG. 1 may include hardware elements (including circuitry), software elements (including computer code stored on a tangible computer-readable medium) or a combination of both hardware and software elements. Further, FIG. 1 is only one example of a particular implementation and is merely intended to illustrate the types of components that may be present in such a device 10. For example, in the presently illustrated embodiment, the electronic device 10 may include input/output (I/O) ports 12, input structures 14, one or more processors 16, memory device 18, non-volatile storage 20, expansion card(s) 22, network device 24, power source 26, display 28, and display control logic 32.

As will be discussed in further detail below, the display control logic 32 may include a backlight driver configured to normally operate a backlight unit of the display 28 in a redundant mode when all light-emitting elements of the backlight unit are functional, and to operate the backlight unit in a non-redundant mode when one or more light-emitting elements of the backlight unit malfunctions and becomes non-operational. When operating in the redundant mode, all of the light-emitting elements of the backlight unit may be controlled to provide an amount of light having a luminance that corresponds to a maximum brightness setting of the display 28. Further, when operating in the non-redundant mode, the remaining operational light-emitting elements may be controlled such that they are capable of providing an amount of light corresponding to the maximum brightness setting of the display 28, even without contribution from the nonoperational light-emitting elements.

The processor(s) 16 may control the general operation of the device 10. For instance, the processor(s) 16 may provide the processing capability to execute an operating system, programs, user and application interfaces, and any other functions of the device 10. The processor(s) 16 may include one or more microprocessors, such as one or more general-purpose microprocessors, application-specific microprocessors (ASICs), or a combination of such processing components. The processor(s) 16 may include one or more processors based upon x86 or RISC architectures, as well as dedicated graphics processors (GPU), image signal processors, video processors, audio processors and/or related chip sets. By way of example only, the processor(s) 16 may include a model of a system-on-a-chip (SOC) processor available from Apple Inc. of Cupertino, Calif., such as a model of the A4 or A5 processor.

Instructions or data to be processed by the processor(s) 16 may be stored in a computer-readable medium, such as the memory device 18, which may include volatile memory, such as random access memory (RAM), non-volatile memory, such as read-only memory (ROM), or as a combination of RAM and ROM devices. The memory 18 may store a variety of information and may be used for various purposes. For example, the memory 18 may store firmware for the device 10, such as a basic input/output system (BIOS), an operating system, various programs, applications, or any other routines that may be executed on the device 10, such as user interface functions, processor functions, and so forth.

The electronic device 10 may also include non-volatile storage 20 for persistent storage of data and/or instructions. For instance, the non-volatile storage 20 may include flash memory, a hard drive, or any other optical, magnetic, and/or solid-state storage media, or some combination thereof. Thus, while depicted as a single device in FIG. 1 for simplicity, it should understood that the non-volatile storage 20 may include a combination of one or more of the above-listed storage devices operating in conjunction with the processor(s) 16. The non-volatile storage 20 may be used to store firmware, data files, image data, software programs and applications, and any other suitable data. Further, the network device 24 may include RF circuitry enabling the device 10 to connect to a network, such as a local area network, a wireless network (e.g., an 802.11x network or Bluetooth network), or a cellular data network (e.g., GPRS, EDGE, 3G, 4G, LTE, WiMax, etc.), and to communicate with other devices over the network.

The display 28 may display various images generated by device 10, such as a graphical user interface (GUI) for an operating system, digital images or video stored on the device, or images representing text (e.g., a text document or e-mail). In the illustrated embodiment, the display 28 may be a liquid crystal display (LCD) device having a backlight unit that utilizes light emitting diodes (LEDs) to provide light to an LCD panel, which may include an array of pixels. For instance, the backlight unit may include LEDs arranged in a direct-lighting configuration (also referred to as full-array or full-matrix lighting) in which LEDs are arranged in an array directly behind the LCD panel, or arranged in an edge-lit configuration, in which one or more groups of LEDs, referred to strings, are arranged along one or more edges of the LCD panel. As will be appreciated, each pixel of the LCD panel may include a thin film transistor (TFT) and a pixel electrode configured to store a charge in response to an applied voltage representing image data. For each pixel, an electrical field generated in response to the stored charge aligns liquid crystal molecules within a liquid crystal layer of the LCD panel to modulate light transmission through a region of the liquid crystal layer corresponding to the pixel. For instance, the perceived intensity of the light emitted through a particular pixel is generally dependent upon the applied voltage, which determines the strength of the electrical field. Thus, collectively, the light emitted from each pixel of the LCD panel, may be perceived by a user as an image displayed on the display (e.g., a color image where a color filter overlays the pixels to form groupings of red, green, and blue pixels).

As shown in FIG. 1, the device 10 further includes display control logic 32. The display control logic 32 may include driving circuitry that provides data signals representative of image data to the pixels of the LCD panel of the display 28. For example, the display control logic 32 may include source driving circuitry and gate driving circuitry that operate in conjunction to send image signals to the pixels of the LCD panel. In one embodiment, the pixels are arranged in rows and columns, wherein the TFTs of each pixel include a gate coupled to a gate line (also called a scanning line) and a source coupled to a source line (also called a data line). During operation, the gate driving circuitry may send an activation signal to switch on the TFTs of the pixels of a particular row, and the source driving circuitry may provide image data signals to the pixels of the activated row along respective source lines (columns). By repeating this process for each row of pixels in the LCD panel, an image frame may be rendered.

The display control logic 32 may also include a backlight driver circuit (discussed in more detail below in FIGS. 7-8) configured to control the amount of backlight illumination provided by the backlight unit of the display 28. For example, in an embodiment where the light source of the display 28 includes one or more LED strings, the backlight driving circuitry may provide an activation signal, such as boost output voltage signal modulated by a pulse width modulation (PWM) signal, that provides power to the LEDs. The luminance of the light provided by the backlight unit may be controlled by varying the duty cycle of the PWM signal, and the brightness of the display 28, as perceived by a user, is based at least partially upon the luminance of the light provided by the backlight unit.

To provide just an illustrative example, an LED driven by a boost output voltage generated using a PWM signal with a duty cycle of 50% (e.g., the signal is logically high and low for the same amount of time within a period) may provide a luminance that is approximately half the brightness when driven by a boost output voltage generated using a PWM signal with a duty cycle of 100% (e.g., the signal is always logically high during the same period). Further, in a PWM controlled implementation, the number of different luminance levels that an LED may provide is dependent upon the resolution of the PWM signal. For example, where the duty cycle of a PWM signal is represented by a 10-bit ($2^{10}$) function, 1024 different duty cycles may be selected, which represents 1024 different luminance levels. As discussed in more detail below, the backlight driver may be configured to operate normally in a redundant mode in which all of the light-emitting elements (e.g., LEDs) are functional, and may operate in a non-redundant mode if one or more of the light-emitting elements become non-functional and in which the remaining functional light-emitting elements are controlled such that they are still able to provide a light output corresponding to the maximum brightness level of the display 28. Further, although shown in FIG. 1 as being a separate from the display 28, it should be understood that the display control logic 32 may also be integrated with the display 28 in other embodiments.

Figure 2:
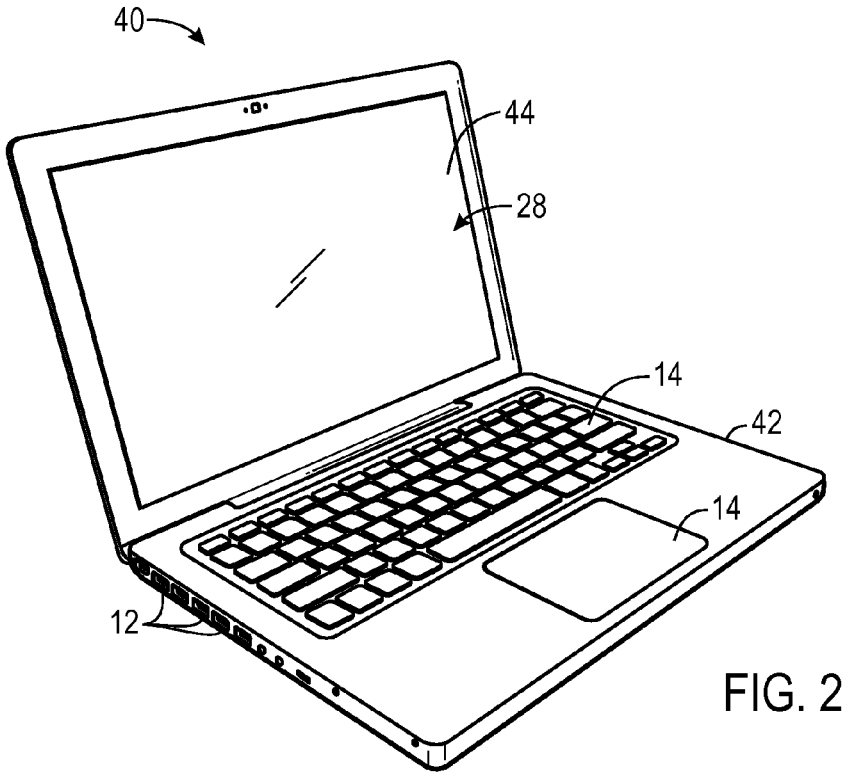
FIG. 2 illustrates the electronic device of FIG. 1 in the form of a computer.
Figure 3:
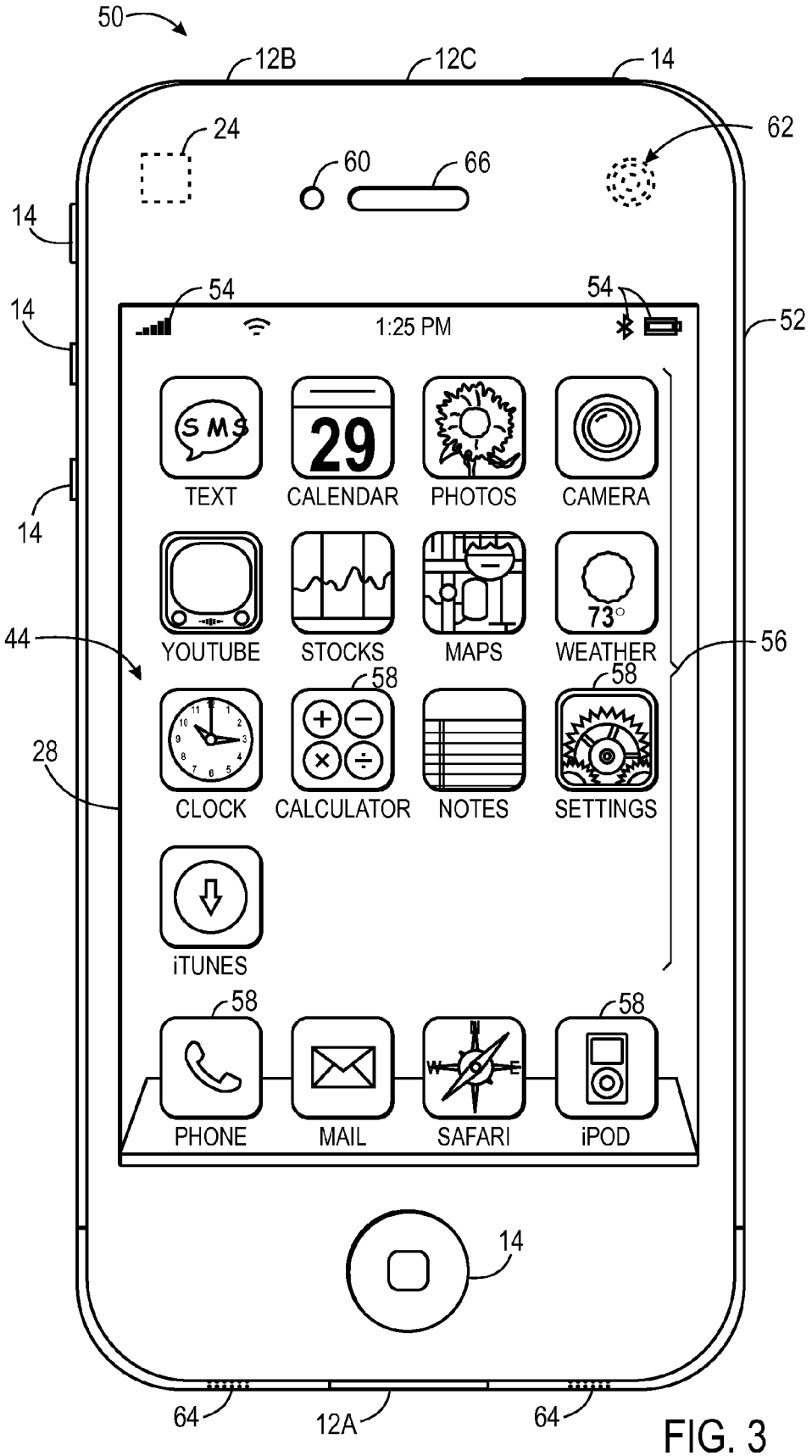
FIG. 3 is a front view of the electronic device of FIG. 1 in the form of a handheld portable electronic device.

To provide some examples of form factors that the electronic device 10 of FIG. 1 may take, FIGS. 2 and 3 illustrate embodiments of the electronic device 10 in the form of a computer and a handheld electronic device, respectively. Referring to FIG. 2, the device 10 in the form of a computer 40 may include generally portable computers, such as laptop, notebook, tablet, and handheld computers, as well as computers generally used in one place, such as desktop computers, workstations and/or servers. The depicted computer 40 includes a housing or enclosure 42, the display 28 (e.g., as an LCD 44 or other suitable display), I/O ports 12, and input structures 14. By way of example only, embodiments of the computer 40 may include a model of a MacBook®, MacBook Pro®, MacBook Air®, iMac®, Mac Mini®, Mac Pro®, or iPad®, all available from Apple Inc.

The display 28 may be an LCD display that includes an LCD panel 44 and a backlight unit that provides light to the LCD panel 44, which may utilize fringe-field switching and/or in-plane switching technologies. The display 28 may be integrated with the computer 40 (e.g., the display of a laptop computer) or may be a standalone display that interfaces with the computer 40 through one of the I/O ports 12, such as via a DisplayPort, Thunderbolt, DVI, High-Definition Multimedia Interface (HDMI) type of interface. In certain embodiments, such a standalone display 28 may be a model of an Apple Cinema Display®, available from Apple Inc.

In further embodiments, the device 10 in the form of a portable handheld electronic device 50, as shown in FIG. 3, may be a digital media player and/or a cellular telephone. By way of example, the handheld device 50 may a model of an iPod® or iPhone® available from Apple Inc. The handheld device 50 includes an enclosure 52, which may protect the interior components from physical damage and may also allow wireless networking and/or telecommunication signals, to pass through to wireless communication circuitry (e.g., network device 24) disposed within the enclosure 52. As shown, the enclosure 52 also includes various user input structures 14 through which a user may interface with the handheld device 50. For instance, each input structure 14 may be configured to control one or more device functions when pressed or actuated.

The device 50 also includes various I/O ports 12, depicted in FIG. 3 as a connection port 12*a* (e.g., a 30-pin dock-connector or Thunderbolt port available from Apple Inc.) for transmitting and receiving data and for charging a power source 26, which may include one or more removable, rechargeable, and/or replaceable batteries. The I/O ports 12 may also include an audio connection port 12*b* for connecting the device 50 to an audio output device (e.g., headphones or speakers). Further, in embodiments where the handheld device 50 provides mobile phone functionality, the I/O port 12*c* may receive a SIM card (e.g., expansion card 22).

The display 28, as implemented in the handheld device 50 of FIG. 3, may include the LCD panel 44 and a backlight unit that operate in conjunction to cause viewable images generated by the handheld device 50 to be rendered on the display 28. For example, the display 28 may display system indicators 54 providing feedback to a user regarding one or more states of handheld device 50, such as power status, signal strength, and so forth. The display 28 may also display a graphical user interface (GUI) 56 that allows a user to interact with the handheld device 50. For instance, the displayed image of the GUI 56 may represent a home screen of an operating system, which may be a version of the Mac OS® or iOS® operating systems, both available from Apple Inc. The GUI 56 may include various graphical elements, such as icons 58, corresponding to various applications that may be executed upon user selection (e.g., receiving a user input corresponding to the selection of a particular icon 58). In one embodiment, user inputs may be received via a touch-screen interface provided with the display 28.

The handheld device 50 may include a front-facing camera 60 and a rear-facing camera 62 (shown in phantom). In certain embodiments, one or more of the cameras 60 or 62 may be used to acquire digital images, which may subsequently be rendered and displayed on the display 28 for viewing. The front and rear facing cameras 60 and 62 may also be utilized to provide video-conferencing capabilities via use of a video-conferencing application, such as FaceTime®, available from Apple Inc. Additionally, the device 50 may include various audio input and output elements 64 and 66. In embodiments where the handheld device 50 includes mobile phone functionality, the audio input/output elements 64 and 66 may collectively function as the audio receiving and transmitting elements of a telephone.

It should be understood that although the LCD display 28 may differ in overall dimensions and size depending on whether it is implemented in a computer 40 (FIG. 2) or in a handheld electronic device 50 (FIG. 3), the overall operating principles are the same, i.e., driving signals representative of image data to pixels of a TFT pixel array. Further, in accordance with aspects of the present disclosure, the computer 40 and handheld device 50 may both include the display control logic 32 (FIG. 1) which may operate to not only send the image data to the pixels of the LCD panel 44 to render viewable images, but also to control a backlight unit in a redundant mode and a non-redundant mode to provide light to the LCD panel 44.

Having discussed the examples of the types of components that may be present in the electronic device 10 of FIG. 1, as well as the various form factors the device 10 may take, additional details of the display 28 may be better understood through reference to FIGS. 4 and 5 below, which shows an exploded perspective view and an assembled view, respectively, of one example of an LCD-based display 28. As shown, the display 28 may include a top cover 70. The top cover 70 may be formed from plastic, metal, composite materials, or other suitable materials, or any combination thereof. In one embodiment, the top cover 70 may be a bezel forming a frame around a viewable region of an LCD panel 44. Additionally, the top cover 70 may also be formed in such a way as combine with a bottom cover 72 to provide a support structure for the remaining elements depicted in FIG. 4.

The LCD panel 44, which may include an array of TFT pixels, may be disposed below the top cover 70. The LCD panel 44 may include a passive or an active display matrix or grid used to control the electric field associated with each individual pixel. As discussed above, the LCD panel 44 may be used to display an image through the use of a layer of liquid crystal material, typically disposed between two substrates. For example, display driver logic (e.g., source driver circuitry and gate driver/scanning circuitry) may be configured to apply a voltage to electrodes of the pixels, residing either on or in the substrates. Depending on the applied voltage, an electric field is created across the liquid crystal layer. Consequently, liquid crystal molecules within the liquid crystal layer may change in alignment in response to the characteristics (e.g., strength) of the electric field, thus modifying the amount of light that may be transmitted through the liquid crystal layer and viewed at a specified pixel. In such a manner, and through the use of a color filter array to create colored sub-pixels, color images may be represented across individual pixels of the display 28.

The LCD panel 44 may include a group of individually addressable pixels. For instance, in an embodiment where the LCD panel 44 serves as a display for a desktop or laptop computer, such as the computer 40 of FIG. 2, the LCD panel 44 may have a display resolution of 1024×768 pixels, representing 768 scanning lines and 1024 columns of pixels, meaning that 1024 pixels are provided for each scanning line. In a color display, each pixel of a column may actually correspond to three sub-pixels, such as a red sub-pixel, green sub-pixel, and blue sub-pixel, for example, each of which are coupled to respective source lines configured to provide red color data signals, green color data signals, and blue color data signals. Thus, in color display embodiments, a resolution of 1024×768 may actually refer describe a display device that has 768 scanning lines, with 3072 sub-pixels per scanning line. In other embodiments, the LCD panel 44 may have resolutions of 2560×1600, 2560×1440, 1980×1080, 1920×1200, 1680×1050, 1600×1024, 1440×900, and so forth. In further embodiments, the LCD panel 44 may serve as a display for a portable handheld electronic device, such as the device 50 of FIG. 3, and may have a display resolution of 480×320 or 960×640 pixels. In one embodiment, the display 28 may be a LCD display having a pixel density of 300 or more pixels per inch, such as a Retina Display®, available from Apple Inc. Further, in some embodiments, the display 28 may be provided in conjunction with the above-discussed touch-sensitive element, such as a touch-screen, functioning as one of the input structures 14 for the electronic device 10.

As will be appreciated, the foregoing resolutions are provided by way of example only. Generally, any desired display resolution may be implemented in an LCD panel 44 of a display device 28 that incorporates a backlight unit configured to normally operate in a redundant mode and to operate in a non-redundant mode when one or more of the light-emitting elements of the backlight unit malfunction, in accordance with the techniques set forth in this disclosure. Moreover, though not explicitly shown in FIG. 4, the LCD panel 44 may further include various additional components, such as polarizing films and/or anti-glare films. Further, in a color display embodiment, the LCD panel 44 may also include a black mask layer having a color filter array that overlays the pixels of the LCD panel 44. The perceived color of each pixel depends on the color of the filter overlaying the pixel. For instance, in certain types of color displays, the color filter array may provide red, blue, and green color filters.

The display 28 also may include optical sheets 74. The optical sheets 74 may be disposed below the LCD panel 44 and may condense the light provided to the LCD panel 44. In one embodiment, the optical sheets 74 may include one or more prism sheets, which may act to angularly shape light passing through to the LCD panel 44. The display 28 may further include an optical diffuser plate or sheet 76. The optical diffuser 76 may be disposed below the LCD panel 44 and either above or below the optical sheets 74 and may be configured to diffuse the light received from the backlight unit as the light is being provided to the LCD panel 44. The optical diffuser 76 generally functions to diffuse the light provided by the backlight unit to reduce glaring and provide uniform illumination to the LCD panel 44. In one embodiment, the optical diffuser 76 may be formed from materials including glass, polytetraflouroethylene, holographic materials, or opal glass. As shown in FIG. 4, the display 28 also includes a light guide 78 (also referred to as a guide plate), which, in conjunction with the optical diffuser 76, may also assist in providing uniform illumination to the LCD panel 44. In illustrated embodiment, the light guide 78 may be part of a backlight assembly arranged in an edge-lit configuration. In such configurations, a light source 80 with light-emitting elements may be disposed along an edge 82 of the light guide 78. The light guide 78 may thus be configured to channel the light emitted from the light source 80 upwards towards the LCD panel 44.

The light source 80 may include light emitting diodes (LEDs) 84, which may include a combination of red, blue, and green LEDs and/or white LEDs. In the illustrated embodiment, the LEDs 84 may be arranged on one or more printed circuit boards (PCBs) 86 adjacent to an edge 82 of the light guide 78 as part of an edge-lit backlight assembly. For example, the PCBs in an edge-lit embodiment may be aligned or mounted along an inner wall 90 of the bottom cover 72 with the LEDs 84 arranged to direct light towards one or more edges (e.g., edge 82) of the light guide 78. In another embodiment, backlight unit may be configured such that the LEDs 84 are arranged on one or more PCBs 86 along the inside surface 92 of bottom cover 72 in a direct-lighting backlight assembly.

The LEDs 84 may include multiple groupings of LEDs, and each grouping may be referred to as an LED string. Each string may include a subset of the LEDs 84s, and the LEDs within each string may be electrically connected in series with the other LEDs within the same string. By way of example only, the LEDs 84 may be grouped into three strings, and each string may include the same number or a different number of LEDs. For example, each LED string may include between 2 to 18 or more separate LEDs. In other embodiments, any number of LED strings may be provided (e.g., 2 to 10 or more strings). As will be appreciated, the number of strings and/or the number of LEDs per string may at least partially depend on the size of the display 28.

As noted above, it is unfortunate, though generally inevitable, that the backlight units of some LCDs (e.g., out of a batch of manufactured LCDs) may suffer from malfunctioning light-emitting elements at some point during their operational life. Thus, embodiments of the present disclosure may provide redundant light-emitting elements which, in conjunction with the above-discussed backlight driver, may allow for the backlight unit to normally operate in a redundant mode, and to operate in a non-redundant mode and continue providing an expected light output even in the event that one or more of the light-emitting elements malfunction. For instance, two types of malfunctions that may occur are an open circuit on the LED string or a short circuit on the entire LED string. The former type of malfunction may cause the entire string to stop functioning, as current ceases flowing through the open circuit LED string, and the latter type of malfunction may cause current to flow through the LED string as if no LEDs were in the string. Indeed, when an LED string includes a single or multiple shorted LEDs, current may "bypass" one or more LEDs (e.g., bypass the anode/cathode terminals) within the string as a result of shorted LEDs, thus rendering the bypassed LEDs nonoperational. Therefore embodiments of the backlight unit may include one or more redundant LED strings and/or one or more redundant individual LEDs on an LED string. The operation of the backlight unit in the redundant and non-redundant modes will be described in further detail below.

Figure 4:
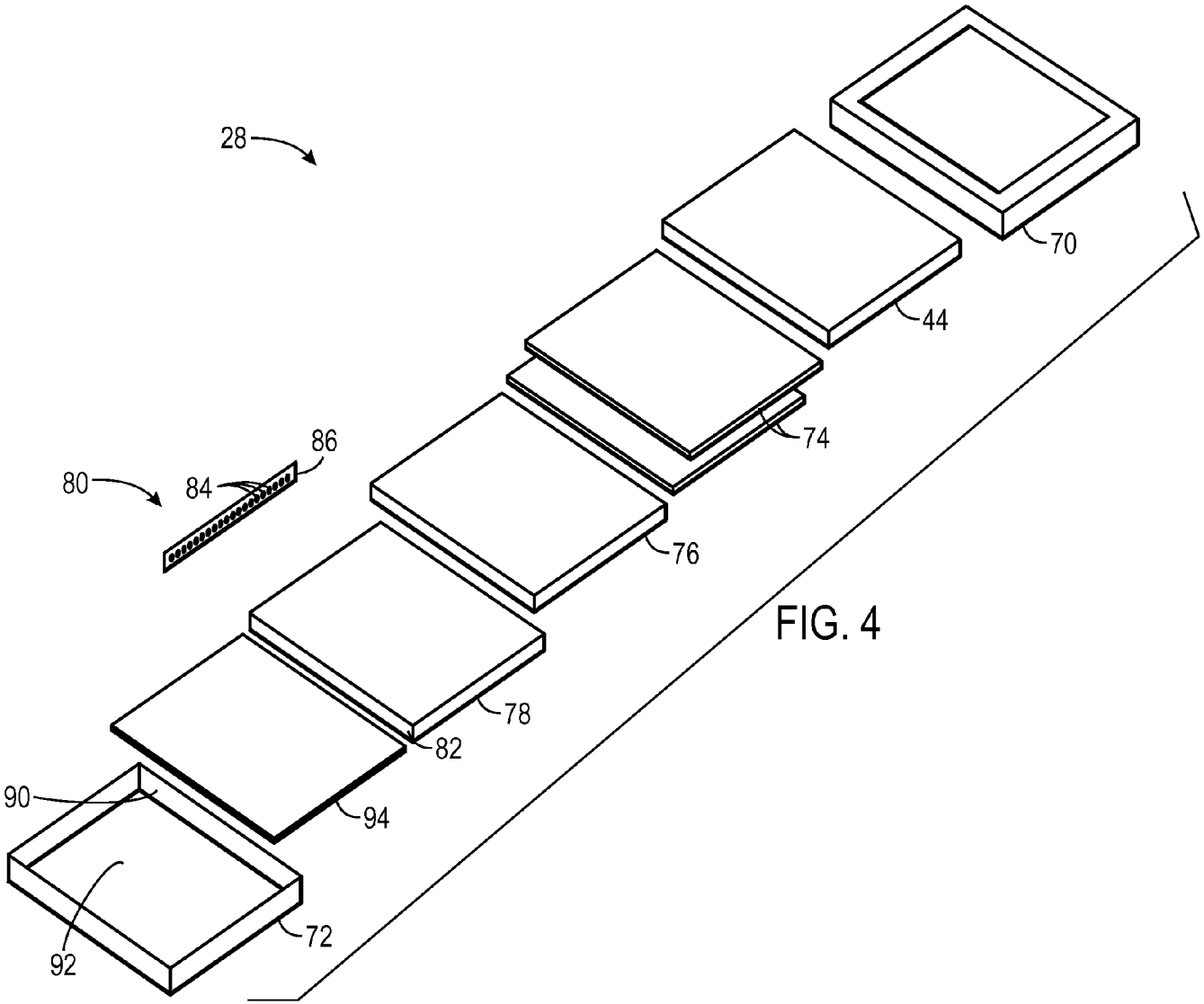
FIG. 4 shows an exploded perspective view of an LCD display that may be part of the electronic device of FIG. 1, in accordance with aspects of the present disclosure.

Referring still to FIG. 4, the LED strings may be arranged on the PCB(s) 86 in either an end-to-end series configuration or in an interleaved configuration. For example, a light source 80 that includes three LED strings in an end-to-end series configuration may be arranged such that the first and last LED in a first LED string are adjacent to a last LED from an second adjacent string and a first LED from a third adjacent string, respectively. Alternatively, in an interleaved configuration, the first, second, and third LED strings may be interleaved with each other, such that any three consecutive LEDs 84 includes an LED from each of the first, second and third strings. However, in this configuration, directly adjacent LEDs may not necessarily be electrically coupled to one another, as they belong to different strings. In yet another embodiment, the LED strings may also be arranged in a side-by-side configuration, with the strings arranged in parallel along an edge 82 of the light guide 78. The backlight driver, which may be implemented using hardware, software, or a combination of hardware and software elements, may provide activation signals to control the switching of the LED strings between on and off states during operation of the display 28. For example, the backlight driver, which may be part of the display control logic 32, may drive the LED strings using the boost voltage and PWM techniques described above. By way of example, the LEDs may include phosphor-based LEDs, such as yttrium-aluminum-garnet (YAG) LEDs configured to emit white light. In other embodiments, separate strings of red light-emitting, blue light-emitting, and green light-emitting LEDs may be utilized, such that their outputs provide generally white light when optically mixed.

As further shown in FIG. 4, the display 28 may also include a reflective plate or sheet 94 generally disposed below the light guide 78. The reflective plate 94 may function to reflect light passing downwards (e.g., away from the panel 44) through the light guide 78 back towards the LCD panel 44. The display 28 also includes the bottom cover 72, as previously discussed, which may be formed in such a way as to join, couple, or otherwise be secured to the top cover 70 to provide a support structure for the elements illustrated in FIG. 4. In some direct-lighting backlight configurations, the reflective plate 94 may be omitted, as light sources arranged along the surface 92 of the bottom cover 72 may emit light directly towards the LCD panel 44.

Figure 5:
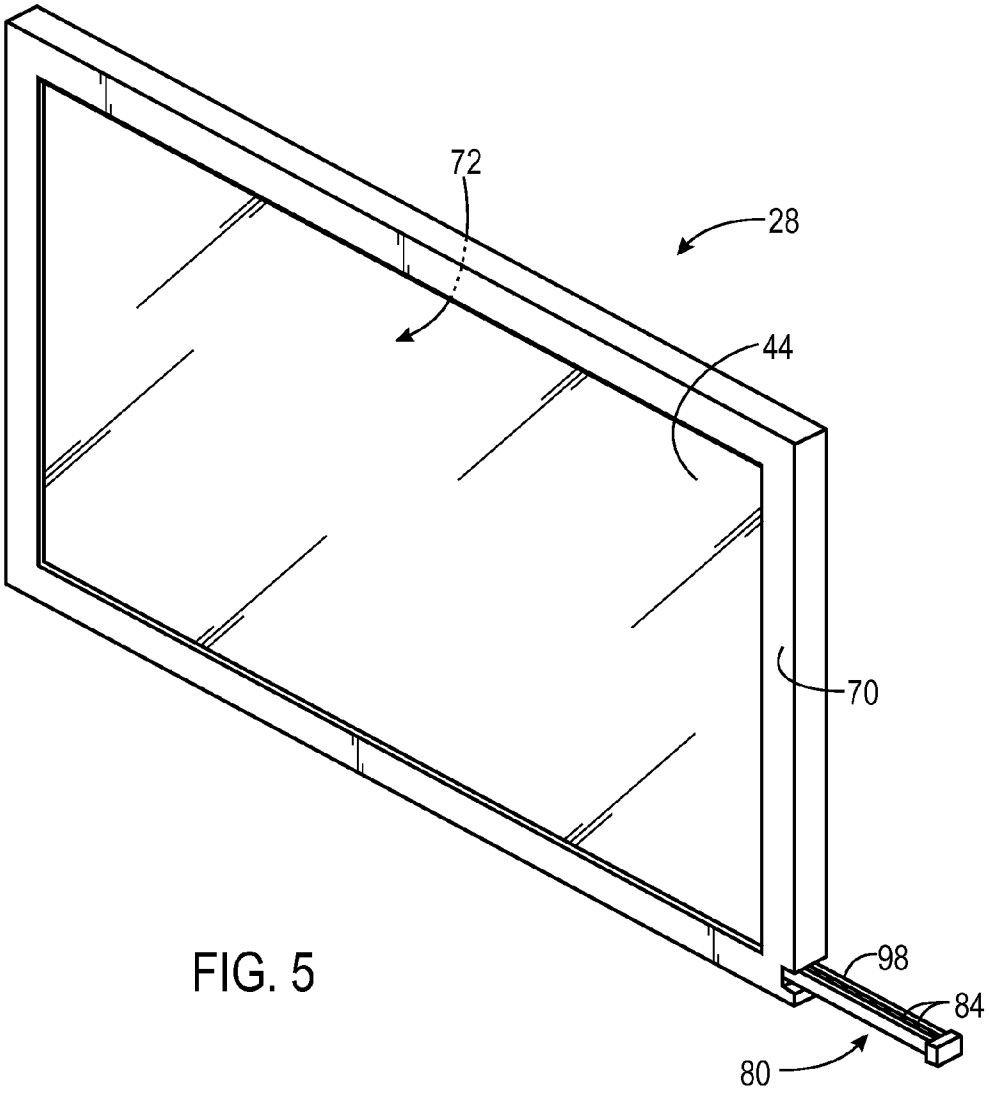
FIG. 5 shows the LCD display of FIG. 4 in an assembled perspective view.

FIG. 5 shows an assembled view of the display 28 of FIG. 4 that employs an edge-lit backlight unit. As shown, the display 28 includes the LCD panel 44, which may be held in place by the top cover 70 and the bottom cover 72. As described above, the display 28 may utilize a backlight assembly such that a light source 80 may include LEDs 84 mounted on a printed circuit board 86. In certain embodiments, the PCB 98 may include a metal core printed circuit board (MCPCB), or other suitable type of support situated upon an array tray 98 in the display 28. The array tray 98 may be secured to the top cover 70 such that the light source 80 is positioned in the display 28 for light generation, which may be utilized to generate images on the LCD panel 44.

Figure 6:
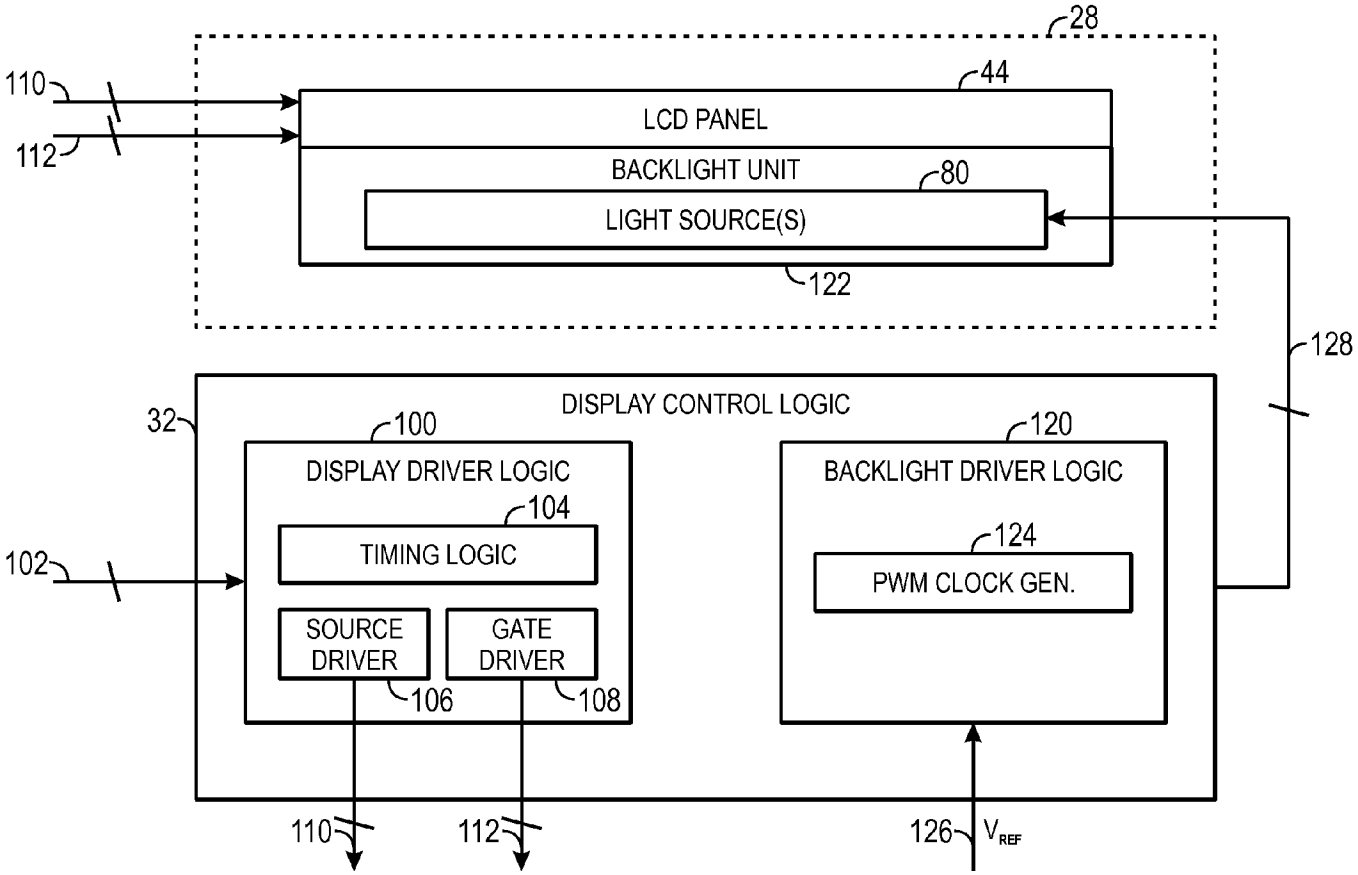
FIG. 6 is a simplified block diagram depicting display control logic that includes backlight driver logic configured to control a backlight to operate in a non-redundant mode and a redundant mode, in accordance with one embodiment of the present disclosure.

FIG. 6 shows a block diagram illustrating an embodiment of the display control logic 32 that may be used to control the display 28 of the electronic device 10. For example, in the illustrated embodiment, the display control logic 32 includes display driver logic 100. The display driving logic 100 may receive data signals 102 representative of image data. For instance, the data signals 102 may represent a digital image retrieved from memory (e.g., memory 18 or storage 20). The display driving logic 100 may include timing logic/controller 104, source driver logic 106, and gate driver logic, as shown in FIG. 6. In operation, the source driver 106 may sequentially send sets of data signals 110 along the source lines of the LCD panel 44, with each set of data signals representing a row of image data. The gate driver 108 may send an activation or scanning signal 112 to an addressed row of pixels corresponding to the row of image data. In this manner, the pixels of an addressed row receive the data signals, which are stored as charges in respective pixel electrodes. This process is repeated for each row of pixels in the LCD panel 44 to render a frame of image data. As can be appreciated, the timing logic 104 may control timing parameters with regard to when the data signals 110 and scanning signals 112 are sent to the LCD panel 44.

As shown, the display control logic 32 also includes backlight driver logic 120, which may be configured to control the light source(s) 80, and thus the overall amount of backlight illumination provided by backlight unit 122. For example, as discussed above, the light source 80 include multiple light-emitting elements, such as LEDs, and the LEDs, which may be arranged in strings, may be toggled between on and off states using an activation signal, such as a boost output voltage signal generated by a pulse width modulation (PWM) signal. Also, as discussed above, the luminance output (which may be expressed in units of nits) of the backlight may be controlled by varying the duty cycle of the PWM signals applied to the LEDs 84. For instance, a boost output voltage generated by a PWM signal having a duty cycle of 50% may achieve a luminance that is approximately half the brightness of constant backlight illumination (e.g., a duty cycle of 100%). In another example, a boost output voltage generated by a PWM signal having a duty cycle of 25% may achieve a luminance that is approximately one quarter of the brightness of constant backlight illumination. Thus, by adjusting the duty cycle of the PWM activation signal(s), the boost output voltage provided to the LEDs 84 of the light source 80 may be used to adjust the brightness of the displayed image.

Accordingly, the illustrated backlight driver logic 120 of FIG. 6 includes a PWM clock generator 124 that may be configured to generate and supply one or more PWM signals to generate the boost output voltage signal 128 to drive the LEDs 84. By way of example, in one embodiment where the light source 80 includes three LED strings, a boost output voltage generated by a PWM signal having a duty cycle corresponding to a desired luminance level may be applied to each of the three LED strings. Accordingly, the change in brightness between each luminance level is dependent on the total number of available luminance levels, which may be based upon the number of bits used to determine the duty cycle of the PWM signal. For instance, if the PWM signal is generated using a 10-bit function, 1024 ($2^{10}$) luminance levels 0-1023 may be available, with each luminance level corresponding to a different duty cycle setting. Thus, in this example, to achieve a brightness setting equal to half of the maximum brightness of the backlight unit 122, a PWM signal having a duty cycle of 50%, which corresponds to a luminance level of 511, may be used to generate the boost voltage signal 128 applied to each of the LED strings of the light source 80. Similarly, if a 12-bit function is used, 4096 ($2^{12}$) luminance levels 0-4095 will be available. Additionally, to generate the PWM signal, a voltage reference signal 126, referred to herein as $V_{REF}$, may be provided to the backlight driver logic 120. $V_{REF}$ may serve as a voltage reference to set the control current level. For instance, in some embodiments, a high pulse of the PWM signal may have a voltage that is determined based at least partially upon the value of $V_{REF}$, providing a current of between approximately 300 to 500 mA. In one embodiment, the PWM generator 124 may provide PWM pulse waveforms having a frequency of between approximately 16 to 24 kilohertz (kHz). For example, it may be desired to use PWM frequency of greater than 20 KHz to remain outside of acoustic band to avoid unwanted audio noise.

Figure 7:
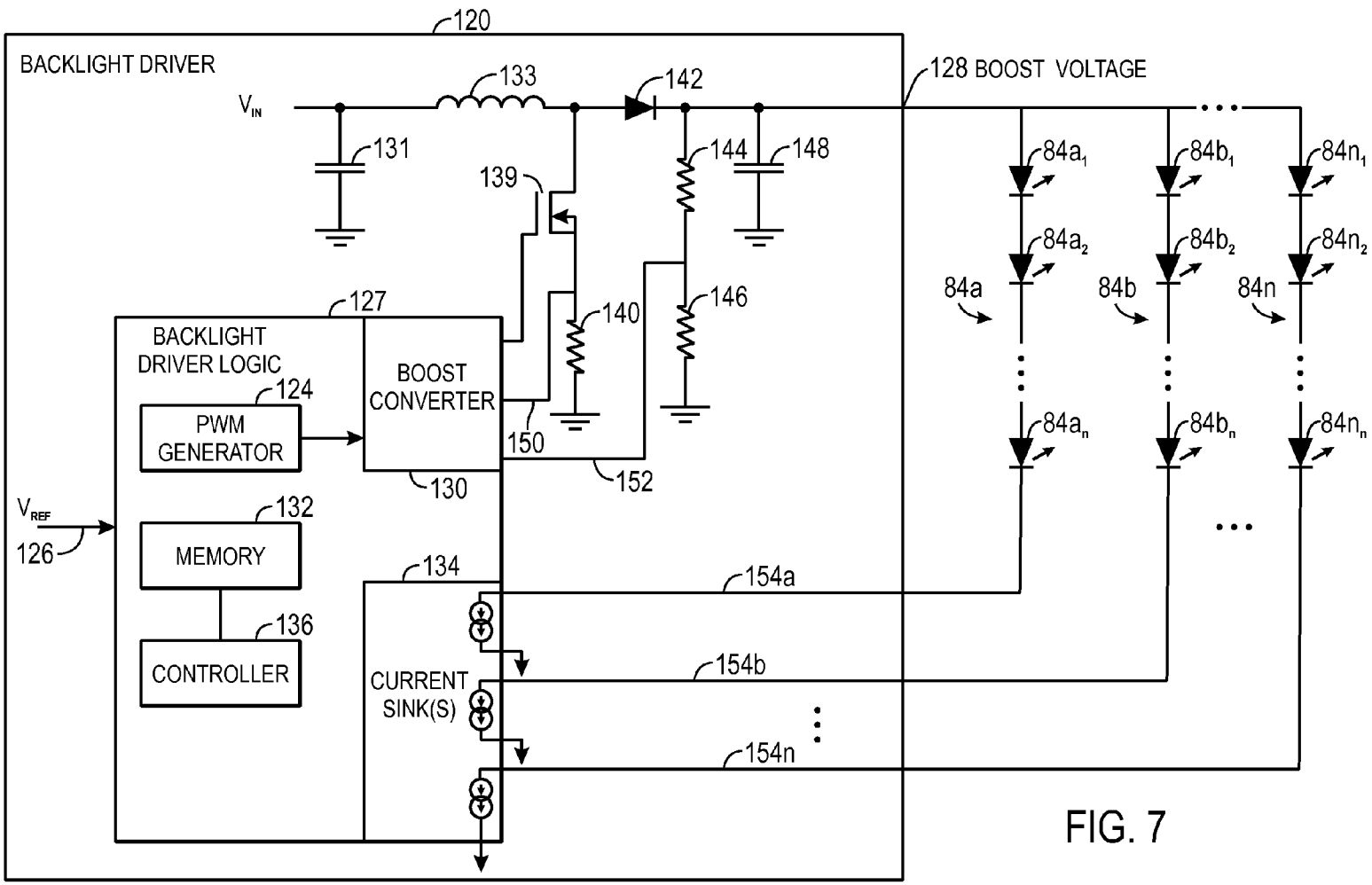
FIG. 7 is a simplified block diagram depicting how the backlight driver logic of FIG. 6 may be connected to multiple LED strings.

FIG. 7 shows a block diagram depicting how the backlight driver 120 may be connected to the light source 80, which include multiple groups of LEDs 84 arranged into LED strings 84*a*, 84*b*, and 84*n*, wherein the LED string 84*n* represents the last LED string (not necessarily a fourth LED string). Indeed, as can be appreciated, any desired number of LED strings may be provided (e.g., 1 to 10 strings) and controlled by the backlight driver 120. Further, each LED string may include multiple LEDs electrically connected in series. For instance, the LED string 84*a* may include LEDs 84$a_1$, 84$a_2$, . . . 84$a_N$. Each LED 84 string may include, for example, anywhere from two to twenty-five LEDs or more. While the schematic diagram shown in FIG. 7 depicts the LED strings 84*a*-84*n* as having the appearance of a parallel electrical arrangement or common boost architecture in which a single boost output voltage is connected to all LED strings 84, it should be understood that the actual physical arrangement may not necessarily correspond to the illustrated schematic, as separate boost architecture can be implemented in which case a separate boost voltage (generated by separate PWM signals and boost convertors) is connected to each LED string 84.

In operation, a reference voltage Vref 126 is supplied to a backlight driver chip 127 that includes the PWM generator 124, a boost convertor 130, a current sink 134, and a controller 136 with memory 132. The PWM generator 124 uses the reference voltage Vref to generate a PWM signal, as described more fully with regard to FIG. 9, which is delivered to the boost convertor 130. The PWM signal determines the amount of power the boost convertor 130 and associated circuitry delivers to the LED strings 84*a-n*.

Figure 8:
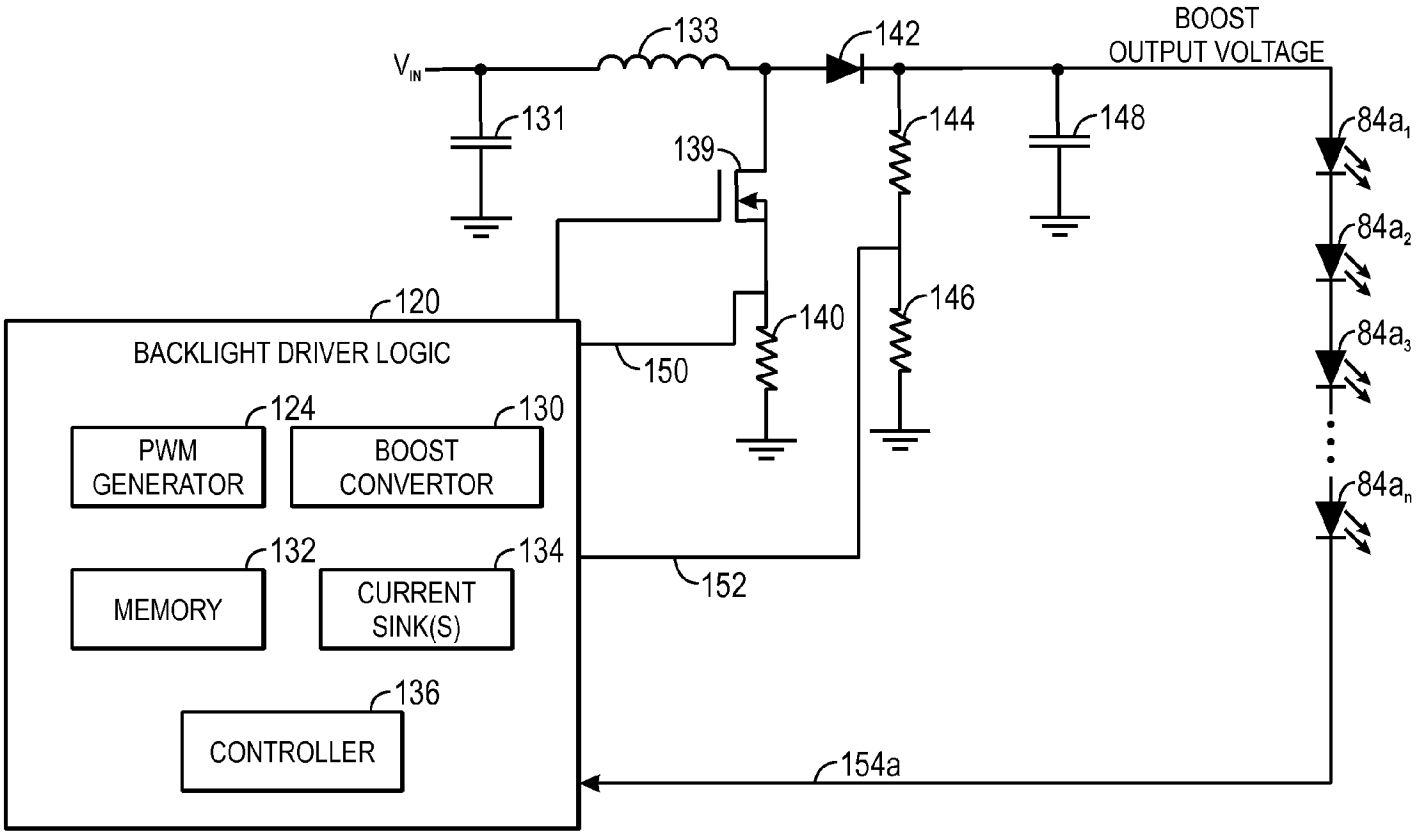
FIG. 8 is a more detailed view showing how the backlight driver logic of FIG. 7 may be configured to detect for malfunction of one or more light sources, in accordance with one embodiment.

Referring to both FIGS. 7 and 8, the schematic diagrams provided illustrate how one or more of the LED strings 84*a-n* may be coupled to the backlight driver 120, as well as how various feedback signals may enable the backlight driver 120 to detect for malfunctions in an LED string 84. As illustrated, the boost output voltage 128 may correspond to a driving signal for one or more of the LED strings 84*a-n* provided by the backlight driver 120. The connection between the backlight driver 120 and the LED string(s) 84 may include an inductor 133, a diode 142, capacitors 131 and 148, resistors 140, 144, and 146, and a transistor 139, arranged as shown in FIGS. 7 and 8. As the boost convertor 130 switches the transistor 139 on, the inductor 133, which is coupled to a voltage source Vin, draws current and begins to charge through the transistor 139 and the resistor 140. The capacitor 131 assists in providing the input current draw to the inductor 133. The peak current is monitored via the feedback signal 150, and the boost convertor 130 will switch the transistor 139 off if the peak current through the inductor 133 reaches a threshold. Once the transistor 139 is turned off, the energy built up in the inductor 133 begins to discharge through the diode 142 after the diode's threshold voltage is exceeded, thus delivering the boost voltage signal 128 to the LED strings 84*a-n*. The capacitor 148 assists in maintaining the current output by the inductor 133 at a substantially constant level. Meanwhile, the boost voltage 128 is monitored by via the feedback signal 152 taken from between the resistors 144 and 146. If it reaches a lower threshold, the boost convertor 130 turns the transistor 139 on again to begin recharging the inductor 133.

Various lines may provide feedback signals 154*a-n* to the backlight driver 120 and may be used to determine whether a malfunction is present in one or more of the LED strings 84*a-n*. In this example, for instance, a malfunction may result if an open or short circuit condition occurs in the string 84*a*, resulting in all of the LEDs 84$a_1$-84$a_N$ becoming nonoperational. Additionally, a malfunction may also occur in the case that a short circuit condition occurs across one or more LEDs within the string 84*a*. In this case, the LED(s) across which the short circuit occurs may become nonoperational. As can be appreciated, each LED string may be connected to the backlight driver 120 in this manner, with each connection either sharing or including a respective set of the resistors 140, 144, 146, diode 142, capacitor 148, and feedback signals 150, 152, and 154.

The boost converter 130 may include a single boost convertor or respective boost converter for each LED string 84*a*-84*n*. The boost converter logic 130 may be configured to adjust a boost output voltage to account for changes in LED forward voltages. The backlight driver 120 may also include a respective current sink 134 for each LED string 84*a*-84*n*. A memory 132 may also be provided and be configured to store configuration and/or calibration parameters related to the operation of the backlight unit 122. Additionally, as described in further detail below, a controller 136 may be configured to determine whether to operate the backlight unit 122 in a redundant mode (normal operation) or in a non-redundant mode. The controller 136 may include one or more data registers configured to enable/disable redundant mode, as well as to provide parameters related to redundant and non-redundant operation.

As described above, the signals 150 and 152 may represent a peak current feedback signal and voltage feedback signal, respectively, associated with the LED strings 84*a-n*. In the embodiment of FIG. 8, feedback signals 150 and 152 may be received by the boost converter 130 associated with the LED string 84*a*. Additionally, the signal 154 may represent a current sink input signal associated with the LED string 84*a*, and may be received by a current sink circuit 134*a* corresponding to the LED string 84*a*. The feedback signals 150, 152, and 154*a* may be used to determine whether the LED string 84*a* is malfunctioning. For instance, substantial drops in peak current, voltage, and/or the current sink input signals may indicate the possible presence of an open circuit condition in the LED string 84*a*. Additionally, the current sink 134 may, based on the received current sink input signal, be able to determine a change in the current through the LED string 84*a* indicates the presence of a short circuit condition somewhere within the string. In further embodiments, the backlight driver 120 may also be configured to acquire temperature information relating to the backlight unit 122, such as via one or more internal thermocouples or from an external temperature sensor. In such embodiments, the presence of a short circuit within an LED string may be determined based upon at least one of the LED current, as detected by the current sink 134, temperature information, as well as comparison of voltage/current in other LED strings.

Figure 9:
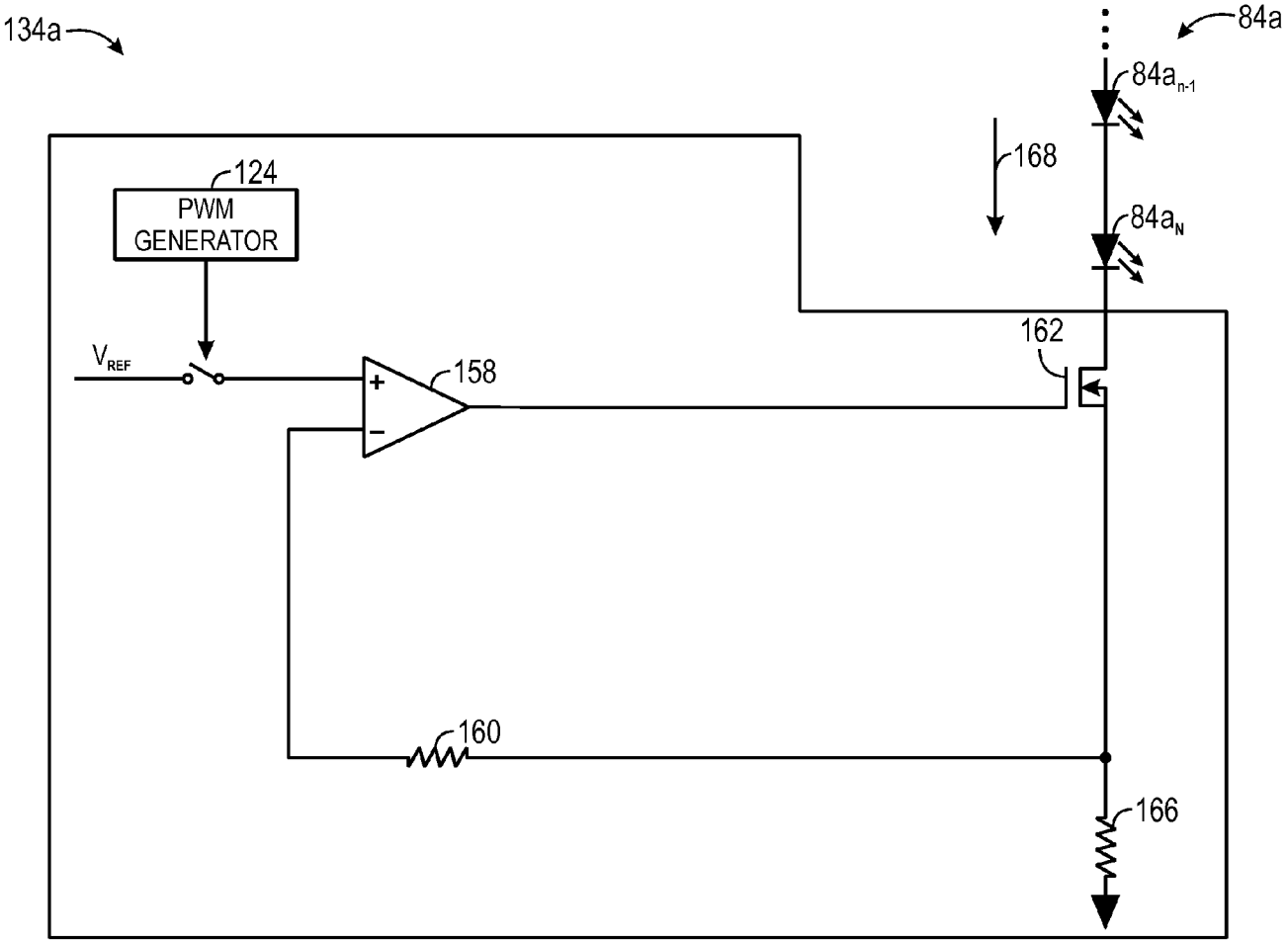
FIG. 9 is a circuit diagram showing an embodiment of a current sink circuit that may be provided as part of the backlight driver logic of FIG. 7.

One embodiment of a current sink is shown in FIG. 9. For example, FIG. 9 may represent a current sink 134*a* corresponding to the LED string 84*a*. In the illustrated embodiment, the current sink circuit 134*a* may include a comparator 158 that receives a PWM signal at a first input, where the PWM signal is generated using a set voltage reference Vref. The duty cycle of the PWM signal is increased or decreased to adjust the boost voltage signal 128 and, thus, the brightness of the LEDs. The current sink 134*a* also includes a feedback resistor 160, transistor 162, and a resistor 166, arranged as shown in FIG. 9. The source terminal of the transistor 162, which may be a MOSFET in some embodiments, is connected to the LED string 84*a* and receives the current 168 from the LED string 84*a*. The resistor 166 may be configured to provide a current sensing function and, in some embodiment, may be implemented using current mirroring techniques. The current sinks 134 may be integrated, which may reduce PCB routing capacitance.

As mentioned above, in addition to open circuit or short circuit failures of the entire LED string, another type of failure that may occur in the LED strings is single or multiple shorted LEDs. Most common root causes of electrical shorts are threading dislocations (also called micropipes or nanopipes) and insufficient or degraded passivation. Elevated dislocation density can result in an increase in leakage current during operation of the LED—i.e. the migration of contact metal through the hollow center of the dislocation creates an ohmic resistance path between the P and N regions of the die and, hense, results in a shorted LED. A redundant operating technique for addressing these types of failures may be referred to herein as "single or multiple shorted LED redundancy," and is described in detail below with reference to FIGS. 10-17.

Figure 10:
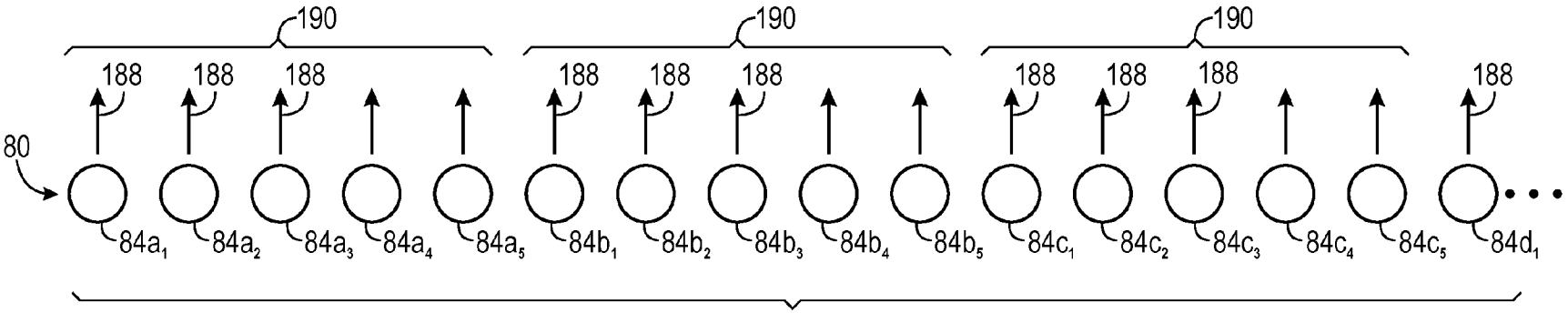
FIG. 10 depicts LED strings of a backlight unit operating in a redundant mode, in accordance with an embodiment of the present disclosure.

For instance, referring to FIG. 10, an example of the light source 80 having multiple LED strings 84*a*-84*d* arranged in an end-to-end series configuration is shown operating in redundant mode. In the illustrated embodiment, the LED strings 84*a*-84*d* are each depicted in a simplified manner with each string having five LEDs (e.g., $\mathbf{84}a_1$-$\mathbf{84}a_5$). However, it should be understood that any number of LEDs may be provided in each string, and that more than four strings may be provided in the light source 80 of the backlight unit. For instance, in one embodiment, the backlight unit may include six LED strings, each having 21-25 LEDs. In redundant mode, each LED of each string is functioning properly to emit light 188. Thus, in redundant mode, the PWM signal driving each string may have a duty cycle that causes the LEDs to provide a light output corresponding to 188. As shown, each LED string may output a luminance represented by reference number 190 (combined output of all LEDs in the string), wherein the total light output of the backlight unit 122 corresponds to the combined luminance 190 of all the LED strings.

Figure 11:
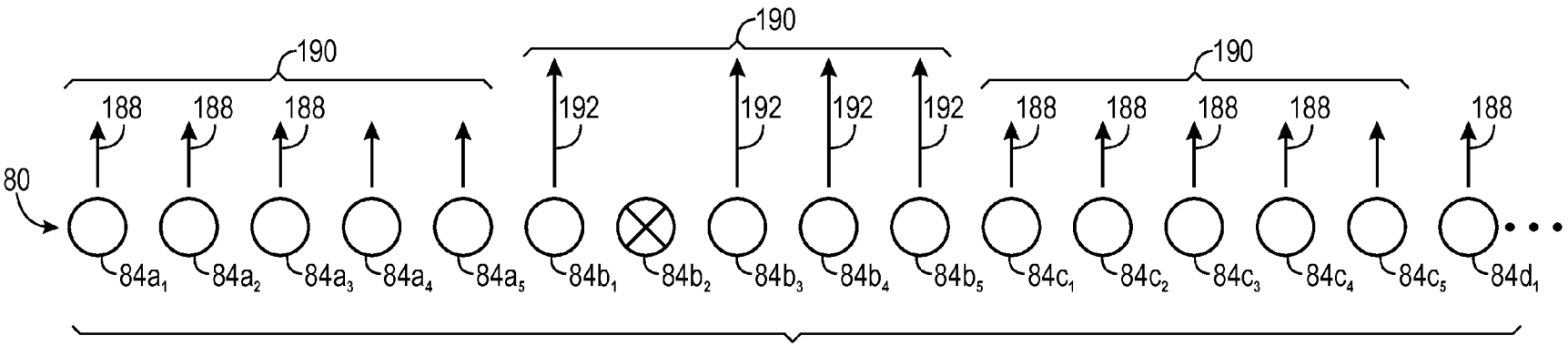
FIG. 11 depicts the LED strings of FIG. 10 operating in a non-redundant mode when a short circuit condition occurs, in accordance with another embodiment of the present disclosure.

FIG. 11 illustrates a scenario in which single shorted LED failure occurs in LED string 84*b*, causing the LED $\mathbf{84}b_2$ to become nonoperational. When this failure is detected by the backlight driver 120, the remaining LEDs ($\mathbf{84}b_1$, $\mathbf{84}b_3$, $\mathbf{84}b_4$, $\mathbf{84}b_5$) within the string 84*b* are operated in a non-redundant mode such that the LED string 84*b* can still achieve the same luminance output 190. For instance, in this case, the duty cycle of the PWM signal driving the LED string 84*b* is increased, such that the remaining functional LEDs $\mathbf{84}b_1$, $\mathbf{84}b_3$, $\mathbf{84}b_4$, and $\mathbf{84}b_5$ output more light, represented here by reference number 192. That is, the backlight driver 120 essentially drives the remaining LEDs of the string 84*b* to provide a light output at a greater intensity to compensate for the failed LED $\mathbf{84}b_2$, such that the overall light output from the string 84*b* is still at least approximately equivalent to the output 190. Additionally, as discussed above, due to optical mixing properties of the light guide 78 and/or optical diffuser 76, a dead spot corresponding to the nonoperational LED (here LED $\mathbf{84}b_2$) is generally not visible. However, LED mixing distance should be kept small enough to minimize the visual effect of the shorted LED failure. Using these techniques, the failure of the LED $\mathbf{84}b_2$ on the string 84*b* is substantially unperceivable by a user viewing the display 28, and the display 28 may continue to operate across its range of brightness settings even without the non-functional LED $\mathbf{84}b_2$. Further, in some embodiments, a short circuit condition may affect more than one LED in a string. For instance, if the LEDs $\mathbf{84}b_2$ and $\mathbf{84}b_3$ fail due to a short circuit condition, the remaining LEDs $\mathbf{84}b_1$, $\mathbf{84}b_2$, and $\mathbf{84}b_3$ may be driven using an adjusted PWM duty cycle to provide a higher light output to compensate for the two nonfunctional LEDs (e.g., the PWM duty cycle may be greater than when only one LED in the string is short circuited).

To provide this shorted LED failure redundancy function, each LED string may include one or more redundant LEDs. For instance, each LED string may include X+Y LEDs, wherein X represents a minimum number of LEDs needed to achieve a maximum desired luminance flux for the LED string and Y represents the number of redundant LEDs in the string. The goal of the short LED redundancy mode is to achieve the same FOS brightness for the display even when one or more LEDs within one or more LED strings of the backlight unit 122 fail due to a short circuit condition. Thus, in redundant mode (where all LEDs within the string are functional), the total luminous flux per string may be expressed as follows:

$$F_{String_red}=F_{X_LEDs}+F_{Y_LEDs} \tag{6}$$

wherein $F_{X_LEDs}$ represents that luminous flux collectively provided by the non-redundant LEDs and $F_{Y_LEDs}$ represents the luminous flux provided by the redundant LEDs. Similarly, the total flux required from each LED string when operating in non-redundant mode may be expressed as:

$$F_{String_red}=F_{X_LEDs} \quad (7)$$

Based on these equations, the maximum PWM duty cycle for achieving the maximum required luminous flux for each string when operating in redundant mode may be determined as a ratio of the number of the minimum number of LEDs required for the string to provide the target maximum luminous flux (e.g., X) to the number of operational LEDs in the string. For example, referring to the example shown above in FIGS. 10 and 11, it may be assumed that each LED string 84*a*-84*d* has five LEDs, with a minimum of four LEDs needed to provide the target maximum luminous flux (e.g., 190) and with one LED operating as a redundant LED. Thus, in redundant mode, when all five LEDs of the string 84*b* are functional, the required PWM duty cycle for achieving the maximum luminous flux for the string 84*b* will be 80% (e.g., 4/5).

However, referring again to FIG. 11, which is the case singe shorted LED failure (e.g., 84$b_2$), the backlight driver may adjust the PWM duty cycle for the string 84*b*, such that the remaining functional LEDs are still capable of providing the maximum luminous flux 190. For instance, in the present example, the adjusted PWM duty cycle may be 100% (e.g., 4/4, since only four LEDs are operational in the string). Thus, the present technique allows for the string 84*b* to still provide the output 190 in the event of a short circuit across one of its LEDs, thus maintaining FOS brightness and masking the defect from being perceived by a user.

As noted above, the embodiments shown in FIGS. 10 and 11 are intended to be simplified examples. In other more complex embodiments, the display 28 may include more LED strings (e.g., 6 or more strings), each with a greater number of LEDs (e.g., 18-24 LEDs). For instance, in one embodiment, each LED string of the backlight unit 122 may include 21 LEDs, with 18 LEDs acting as non-redundant LEDs and 3 LEDs acting as redundant LEDs. Thus, in this embodiment, in redundancy mode, a PWM duty cycle of approximately 85.714% (e.g., 18/21) may be used to drive each LED string to provide a maximum luminous flux. However, if one of the LEDs in the string fails due to a short circuit, then the backlight driver 120 may operate the remaining functional LEDs in the string using a PWM duty cycle of 90% (e.g., 18/20) to achieve the same maximum luminous flux. Further, if another LED in the string fails due to a short circuit, the PWM duty cycle may be adjusted again. For instance, when a total of two LEDs become non-functional, the backlight driver 120 may drive the remaining functional LEDs in the string using a PWM duty cycle of approximately 94.74% (e.g., 18/19). If a third LED also short circuits and becomes non-functional, the remaining LEDs in the string may be driven using a 100% PWM duty cycle.

Thus, similar to the N+1 redundancy mode discussed above, the shorted LED redundancy mode essentially limits the maximum PWM duty cycle of each string when operating in redundant mode, while increasing the PWM duty cycle as individual LEDs fail. As can be appreciated, each LED string of the backlight may be configured in this manner. Thus, backlight driver 120 may adjust the PWM duty cycle accordingly for any of the LED strings when a failed LED due to a short circuit is detected. As such, the backlight driver 120 may preserve the FOS brightness performance of the display even in the event that some LEDs within a string fail without the user perceiving any effects resulting from the failed LED(s). It should be understood that no particular LEDs within the string are necessary designated as redundant LEDs. That is, the redundancy is provided in the sense that all LEDs are normally operated, but that in the case of a short circuit condition, the remaining LEDs driven to produce more light to compensate for the failed LED(s).

Figure 12:
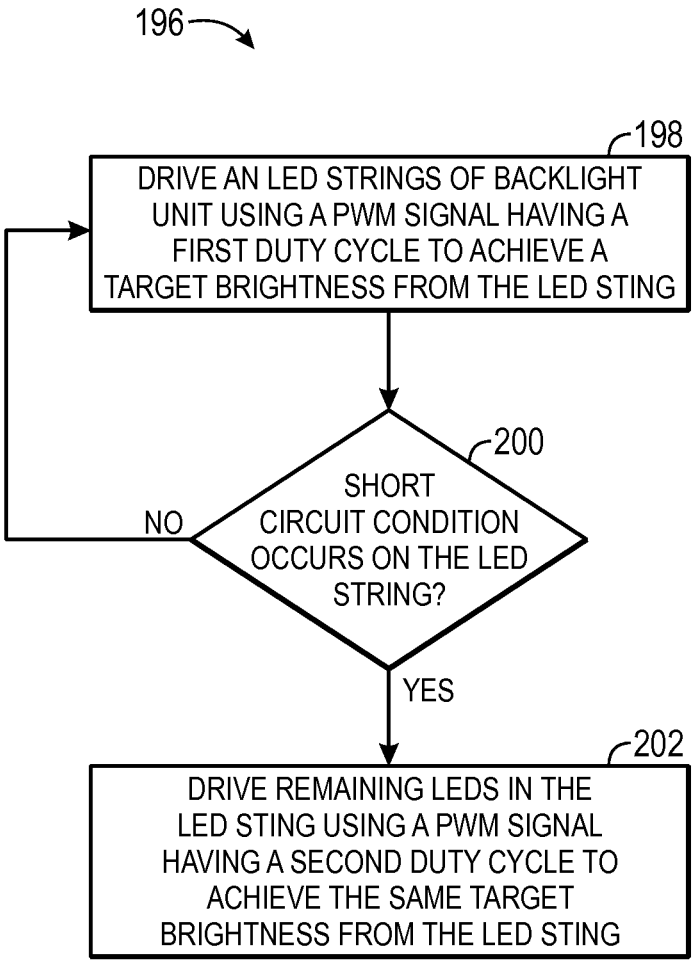
FIG. 12 is a flowchart depicting a process for operating a backlight unit to provide redundancy in the event of a short circuit condition, in accordance with an embodiment of the present disclosure.

FIG. 12 is a flowchart depicting a process 196 that illustrates how the backlight driver 120 may implement the shorted LED redundancy techniques described above. The process 196 begins by driving an LED string having multiple LEDs in redundant mode using a PWM signal having a first duty cycle for achieving a target brightness (block 198). For instance, the target brightness may correspond to a maximum expected luminous flux from the LED string, such that when all LED strings of the backlight unit are driven to provide this target brightness, a maximum FOS brightness setting of the display 28 is achieved. From block 198, decision logic 200 may determine whether a shorted LED failure condition occurs within the LED string, causing an LED to become non-functional. For instance, as discussed above, the voltage drop across current sink signal 154 for each LED string and/or temperature information may be monitored by the backlight driver 120 to detect for the occurrence of short circuit conditions. If no shorted LED failure is detected, the process 196 returns from decision logic 200 to block 198. However, if a shorted LED failure is detected, then decision logic 200 proceeds to block 202, and the backlight driver 120 transitions to operate the remaining functional LEDs within the LED string in non-redundant mode using a PWM signal having a second duty cycle. As discussed above, the second duty cycle is greater than the first duty cycle due to the limiting of the maximum PWM duty cycle when operating in redundant mode. For instance, the second PWM duty cycle may be determined as the ratio of the number of non-redundant LEDs to the number of functional LEDs within the string.

As can be appreciated, the embodiment described above in FIGS. 10 and 11 may relate to a 0D or 1D backlight scanning technique. 1D scanning may be used which generally refers to a configuration in which separate groups of light sources (e.g., LED strings) are independently controllable which may provide a solution to motion blur problem. 2D scanning, which is described in a further embodiment below, may refer to a configuration in which each individual light source is independently controllable. 0D scanning may refer to a configuration in which all the light sources are controlled together. For instance, the short LED redundancy technique described above may also be applied to 0D scanning. Essentially, a 0D scanning embodiment is a special case in which the backlight unit 122 either includes single LED string that is controlled by one signal, or multiple LED strings which are phase shifted from each other (phase shifting=360 deg/number of strings).

Figure 13:
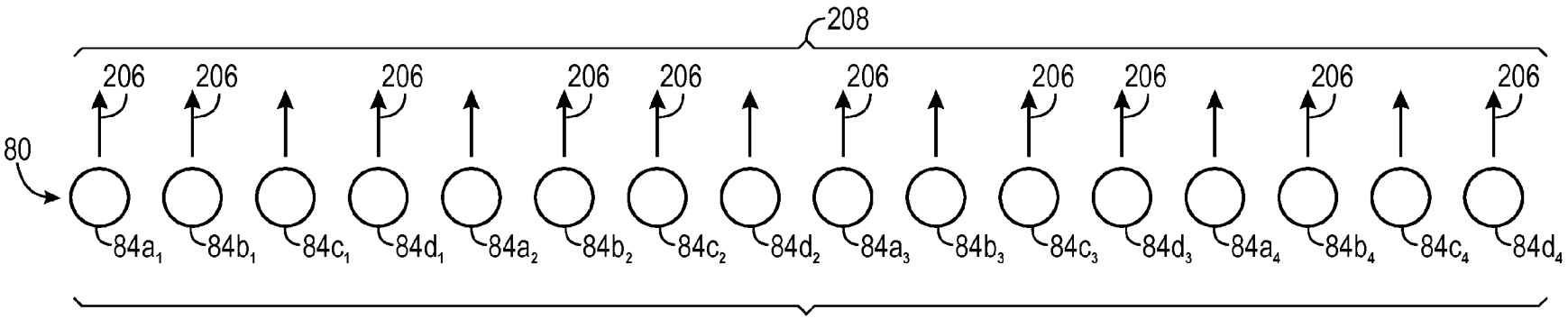
FIG. 13 depicts LED strings of a backlight unit operating in a redundant mode, in accordance with an embodiment of the present disclosure.
Figure 14:
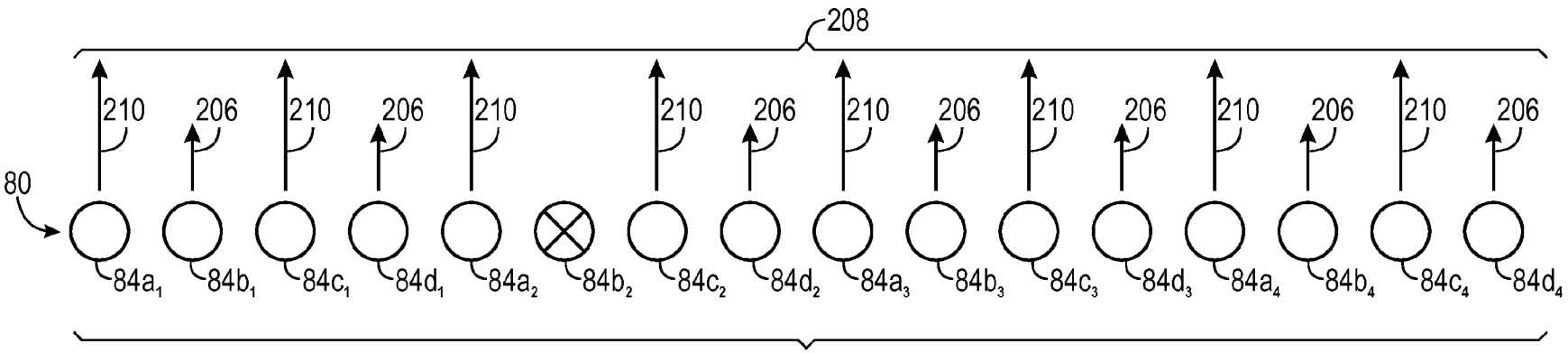
FIG. 14 depicts the LED strings of FIG. 13 operating in a non-redundant mode when a short circuit condition occurs, in accordance with another embodiment of the present disclosure.

Referring to FIGS. 13 and 14, another embodiment of how shorted LED redundancy may be implemented is illustrated with respect to a 1D scanning configuration in which the LED strings 84*a*-84*d* of the light source 80 are arranged in an interleaved configuration. Again, it should be understood that while FIG. 13 depicts four LED strings each having four LEDs, this illustration is intended to be a simplified example only. FIG. 13 illustrates a redundant mode of operation, in which each LED of each string 84*a*-84*d* is functioning properly to emit light 206. For the purposes of this example, the light output 206 from each LED 84 may be assumed to correspond to a maximum luminous flux of each LED, such that the combined luminous flux 208 from the light source 80 represents a maximum brightness setting for the display.

FIG. 14 illustrates a scenario in which a shorted LED failure occurs in LED string 84*b*, causing the LED 84$b_2$ to become nonoperational. When this failure is detected by the backlight driver 120, the light source 80 is operated in a non-redundant mode, wherein the LED strings containing the LEDs directly adjacent to the failed LED 84$b_2$, here LED strings 84*a* and 84*c*, are driven using an increased PWM duty cycle to increase the light output from the LEDs of the strings 84*a* and 84*c*, as indicated by reference number 210. The increased PWM duty cycle may be calculated such that the light output 210 from the LED strings 84*a* and 84*c* and the light output 206 from the LED string 84*d* and the remaining LEDs of the string 84*b* collectively provide the same maximum luminous flux 208, thus allowing the display 28 to continue operating across its intended range of brightness settings without the short circuit condition being perceivable by the user. Further, while the presently illustrated embodiment depicts the adjusted PWM duty cycle as causing the LEDs of strings 84*a* and 84*c* to provide the same light output 210, other embodiments may only adjust the PWM duty cycle for one of the strings or may adjust the PWM duty cycle setting of both strings by different amounts.

Figure 15:
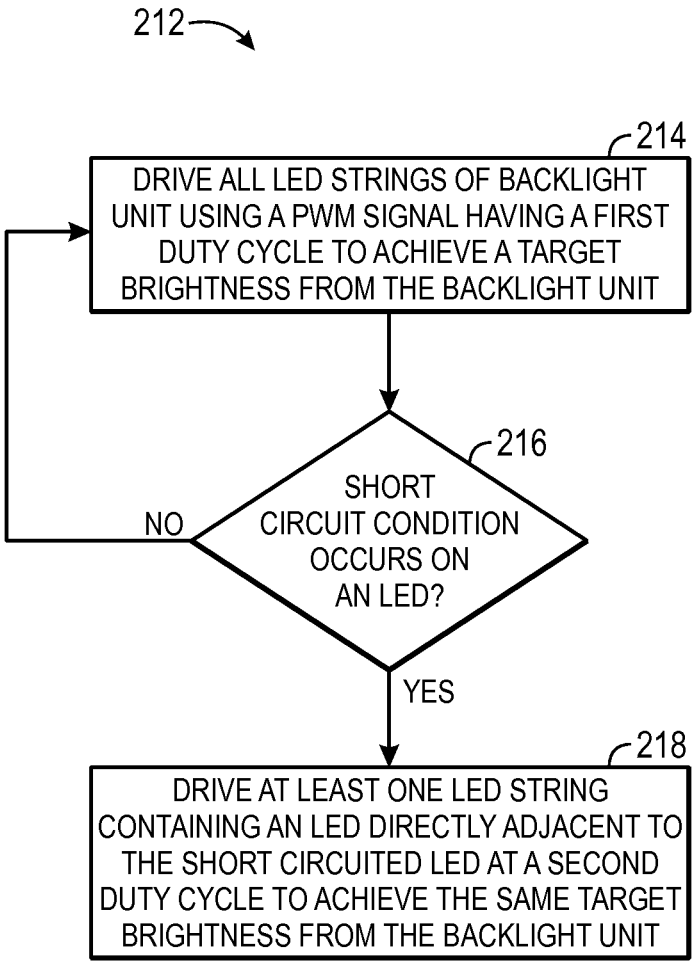
FIG. 15 is a flowchart depicting a process for operating a backlight unit to provide redundancy in the event of a short circuit condition, in accordance with another embodiment of the present disclosure.

FIG. 15 is a flowchart depicting a process 212 illustrating how the backlight driver 120 may implement the shorted LED redundancy techniques described above in FIGS. 16-17. The process 212 begins by driving all the LED strings of the backlight unit 122 in a redundant mode using a PWM signal having a first duty cycle for achieving a target brightness (block 214). The target brightness may correspond to a maximum expected luminous flux from all LED strings, which may correspond to a maximum FOS brightness setting of the display 28. Next, decision logic 216 may determine whether a shorted LED failure occurs in any of the LED strings. If no shorted LED failure is detected, the process 212 returns from decision logic 216 to block 214. However, if a shorted LED failure is detected, then decision logic 216 proceeds to block 218, and the backlight driver 120 transitions to operate the remaining functional LEDs within the LED string in non-redundant mode, where at least one LED string containing an LED that is directly adjacent to the shorted LED is driven at a second PWM duty cycle to achieve the same target brightness from block 214.

Figure 16:
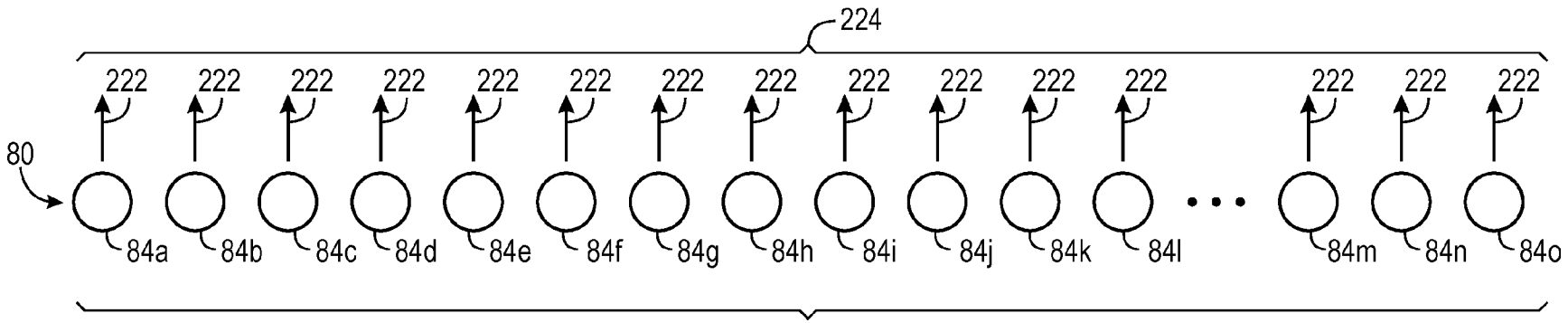
FIG. 16 depicts LEDs of a backlight unit configured to implement 2D scanning operating in a redundant mode, in accordance with an embodiment of the present disclosure.
Figure 17:
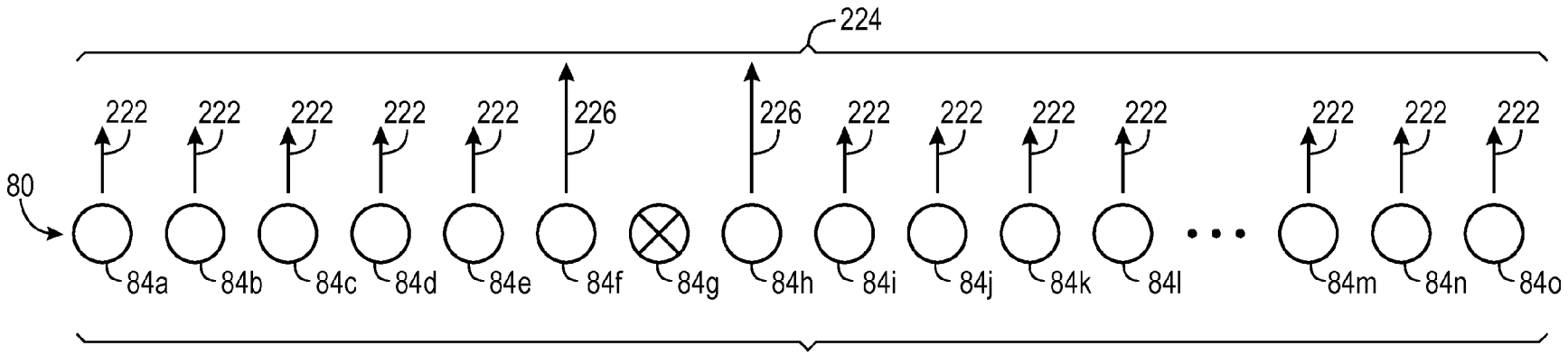
FIG. 17 depicts the LEDs of FIG. 16 operating in a non-redundant mode when one of the LEDs becomes nonoperational, in accordance with another embodiment of the present disclosure.

Continuing to FIGS. 16 and 17, embodiments of how a shorted LED redundancy technique may be implemented in a display with a backlight unit operated using 2D scanning are illustrated. Referring first to FIG. 16, the light source 80 may include multiple LEDs 84*a*-84*o* configured to provide 2D backlight scanning. Again, this illustration is merely intended to be simplified example. In other embodiments, the light source may include any desired number of LEDs, i.e., between approximately 20 to 150 LEDs, depending on the dimensions and size of the display 28. As discussed above, in 2D scanning, each individual LED 84*a*-84*o* may be independently controlled. That is, each LED 84*a*-84*o* may be driven with a respective PWM signal generated by the PWM generator 128 of the backlight driver 120. FIG. 16 illustrates a redundant mode of operation, in which all of the LEDs 84*a*-84*o* are functioning properly to emit light 222. For the purposes of this example, the light output 222 from each LED 84*a*-84*o* may be assumed to correspond to a maximum luminous flux of each LED, such that the combined luminous flux 224 from the light source 80 represents a maximum brightness setting for the display.

FIG. 17 illustrates a scenario in which a shorted LED failure occurs, causing single LED in one segment to stop functioning. When this failure is detected by the backlight driver 120, the light source 80 is operated in a non-redundant mode, wherein the rest of the LEDs in that segment are driven using an increased PWM duty cycle to increase the light output from the affected segment. This increased PWM duty cycle may be calculated such that the light output from all of the remaining functional LEDs provides the same maximum luminous flux 224, thus allowing the display 28 to continue operating across its intended range of brightness settings without the short circuit condition being perceivable by the user.

As discussed above, the backlight driver 120 may normally operate the backlight unit 122 of the display 28 in a redundant mode, such at all LEDs 84 are utilized to provide light. However, if an open circuit or short circuit condition of most or all LEDs is detected in any of the LED strings 84*a*-84*n*, the controller 136 may cause the backlight driver 120 to disable the redundant mode of operation and operate in a non-redundant mode. When operating in the non-redundant mode (e.g., following the malfunction of one or more LEDs), the remaining operational LEDs are controlled in a way such that at least approximately the expected range of brightness settings (e.g. a minimum brightness setting to a maximum brightness setting) for the display device 28 may still be achieved without the user perceiving any noticeable difference in the operation of the backlight unit 122. Thus, the non-redundant modes may be viewed as a backup mode that is utilized when one or more LEDs fail.

With these points in mind, one type of redundant operation may be utilized to compensate for an open circuit LED string. For example, an open circuit may occur due to a disruption somewhere along the circuit path of the LED strings. For instance, an open circuit may occur when one of the LEDs within the strings becomes non-conductive, thus preventing current from flowing through, or when a break forms in the wiring between the LED strings. This type of redundant operation, which may be referred to herein as "N+1" redundancy mode, is described below with reference to FIGS. 18-20. For instance, referring first to FIG. 18, an example of the light source 80 having three LED strings 84*a*-84*c* arranged in an interleaved manner is shown operating in redundant mode. Thus, in FIG. 18, all LEDs are working properly. For the purposes of this example, it may be assumed that each LED is presently outputting an equal amount of light represented by reference number 270, and that the net light output has a luminous flux 272. Generally, the net light output 272 appears as uniform light due to optical mixing by the light guide 78 and/or optical diffuser plate 76 (FIG. 4). As can be appreciated, the light output 270 and the total luminous flux 272 that corresponds to a maximum brightness setting will depend on the maximum brightness setting of the display device 28. For instance, in some displays, a maximum brightness setting may correspond to a front-of-screen (FOS) brightness of approximately 300 to 350 nits (cd/m$^2$). Accordingly, when operating in redundant mode, the PWM signals 128 driving the LED strings 84*a*-84*c* may have a duty cycle corresponding to the light output 270.

Figure 19:
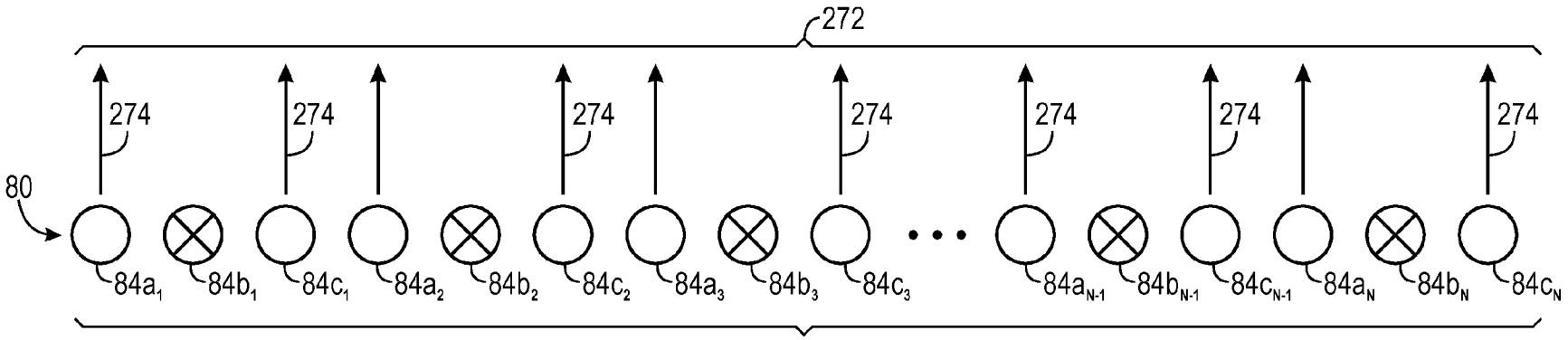
FIG. 19 depicts the LED strings of FIG. 18 operating in a non-redundant mode when an open circuit condition occurs, in accordance with an embodiment of the present disclosure.

FIG. 19 illustrates a scenario in which a condition, such as an open circuit or most/all LEDs shorted (i.e., a shorted LED string condition), causes one of the LED strings, here string 84*b*, to stop operating. In this case, all of the LEDs 84$b_1$-84$b_N$ stop emitting light. One of the major reasons of an electrical open in an LED is thermo-mechanical stress of the wire bonds. However, electrostatic discharge (ESD) or electrical overstress (EOS) to the die may also cause such an electrical open circuit or multiple short circuit condition. When this failure is detected by the backlight driver 120, the remaining LED strings, here strings 84*a* and 84*c*, are operated in a non-redundant mode in order to still achieve the same luminous flux output 272. For instance, in this case, the PWM duty cycle of the signals driving each of the LEDs of the remaining strings 84*a* and 84*c* may be increased, such the LEDs 84$a_1$-

84$a_N$ and 84$c_1$-84$c_N$ each output more light, represented here by reference number 274. That is, the backlight driver 120 essentially drives the remaining LED strings (84*a*, 84*c*) to provide a light output at a greater intensity to compensate for the failed LED string (84*b*), such that the light contributions from the remaining strings still achieve the same net luminous flux 272. Due to optical mixing properties of the light guide 78 and/or optical diffuser 76, "dead" spots corresponding to the nonoperational LEDs are masked. Thus, using these techniques, the failure of the LED string 84*b* is substantially unperceivable by a user viewing the display 28, and the display 28 may continue to operate across its range of brightness settings even without the nonoperational LED string 84*b*.

To configure the backlight driver 120 to provide this N+1 redundancy function, any one of the LED strings of the backlight may be considered as a redundant string, with the total number of LED strings provided in the backlight being represented by N+1. Two cases are considered: (1) when all N+1 LED strings are operational (where "+1" represents the redundant string), and (2) when only N LED strings are operational (when one LED string fails). As part of this determination, a maximum desired luminance level or brightness is first determined, and a total luminous flux value corresponding to the desired maximum luminance is calculated. For instance, in redundant mode (N+1 strings operational), the luminous flux for each LED string may be determined as follows:

$$F_{String_red} = \frac{F_{total}}{N+1}; \tag{1}$$

wherein $F_{String_red}$ represents the luminous flux required for each LED string in redundant mode, wherein N+1 represents the total number of LED strings, and wherein $F_{total}$ represents the total luminous flux corresponding to the desired maximum luminance, as discussed above. Next, the luminous flux for each LED string for non-redundant mode is also determined. This may be based on the following equation:

$$F_{string_non-red} = \frac{F_{total}}{N}; \tag{2}$$

wherein $F_{String_non\text{-}red}$ represents the luminous flux required for each LED string in non-redundant mode, and wherein N represents the number of LED strings remaining when one string fails.

After $F_{String_non\text{-}red}$ and $F_{String_red}$ are determined, the maximum PWM duty cycle required for each string to achieve the maximum luminous flux in redundancy mode may be calculated as follows:

$$D_{Max_red} = \frac{F_{String_red}}{F_{String_non-red}}; \tag{3}$$

$$= \frac{F_{total}}{N+1} \times \frac{N}{F_{Total}}; \tag{4}$$

$$= \frac{N}{N+1}; \tag{5}$$

Figure 18:
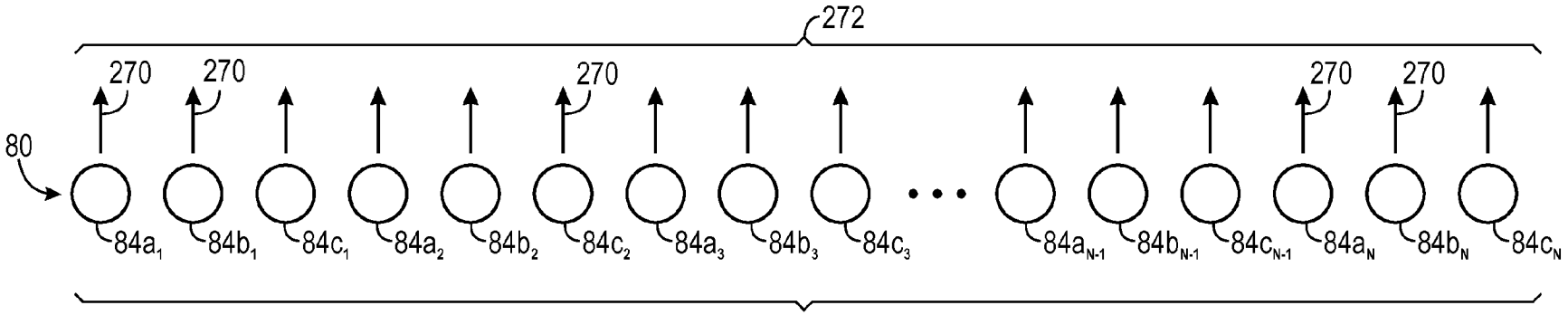
FIG. 18 depicts LED strings of a backlight unit operating in a redundant mode, in accordance with an embodiment of the present disclosure.

Thus, referring to the example shown in FIGS. 18 and 19, when N+1 is equal to three LED strings, the maximum PWM duty cycle is 2/3, or approximately 66.67%. Thus, in an embodiment utilizing three LED strings, a PWM dimming range of 0-66.67% may be used, wherein the luminance will be at its maximum when the PWM signals driving the LED strings are set to 66.67%. As can be appreciated, this leaves a headroom of approximately 33.33% for non-redundant operation. For example, in the example illustrated in FIG. 19, when one of the three LED strings becomes non-operational, the PWM dimming range is adjusted to 0-100% with substantially no perceivable change in the FOS brightness. That is, driving the initial three LED strings 84*a*-84*c* each at 66.67% duty cycle will be perceived substantially the same by the user when driving the remaining two LED strings 84*a* and 84*c* each at a 100% duty cycle. The mixing area of LEDs should be small enough to minimize any visual effects of entire LED string failure due to an open circuit condition or short circuit condition of an entire string. Also, the PWM-based dimming method is described herein as one example, but it will be appreciated that any other suitable dimming methodologies, including linear dimming for example, may be utilized. Further, the PWM dimming duty cycle may not be change linearly with brightness (Cd/m$^2$).

Thus, the N+1 redundancy mode discussed herein essentially limits the maximum PWM duty cycle (or maximum brightness) when operating in redundant mode. As can be appreciated, this may result in a decreased PWM dimming ratio, since, depending on the PWM function, lesser number of duty cycle values are available, thus reducing the luminance resolution. For instance, assuming a 10-bit PWM function corresponding to 1024 luminance settings is used, only approximately 683 (66.67%) of those values are utilized in redundancy mode. Accordingly, in some embodiments, certain techniques may be utilized in redundancy mode to compensate for reduced dimming ratio, such as utilizing static dithering, extended PWM cycle-based dimming, and/or mix-mode dimming schemes. Further, in some embodiments, a higher overall PWM resolution may be used, such as by increasing the bit-resolution of the PWM function. For instance, a 16-bit PWM function may provide for 65,536 possible luminance levels.

In the embodiments discussed above, the redundancy modes are provided by limiting the maximum PWM duty cycle. In other embodiments, similar functionality may also be provided by varying LED current between redundant and non-redundant operation instead of or in addition to limiting PWM duty cycle. Varying LED current (e.g., amplitude modulation) may be referred as linear dimming. However, it should be appreciated that changes in LED current may result in color shifts in some cases. Thus, it may generally be desirable to utilize current-varying techniques in instances where color shift is less of an issue or not an issue at all. Further, it should be appreciated that the use of three LED strings in FIGS. 18 and 19 is only intended to be one example. Indeed, any number of LED strings may be provided in the backlight unit 122 and operated in redundant and non-redundant modes based on the techniques described above. For instance, in an backlight unit 122 with six LED strings, all six LED strings may be driven at approximately an 83.33% duty cycle in redundancy mode and 100% in non-redundancy mode to achieve a maximum FOS brightness.

Figure 20:
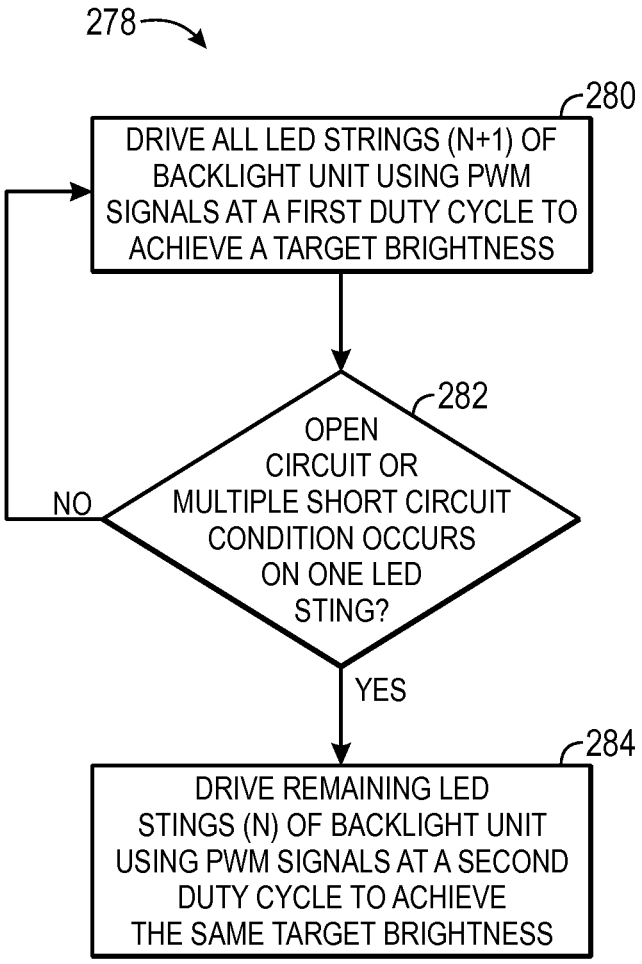
FIG. 20 is a flowchart depicting a process for operating a backlight unit to provide redundancy in the event of an open circuit condition, in accordance with an embodiment of the present disclosure.

FIG. 20 is a flowchart depicting a process 278 illustrates how the backlight driver 120 may implement the N+1 redundancy techniques described above. The process 278 begins by driving all the LED strings (e.g., N+1 strings) of the backlight unit in redundant mode using PWM signals having a first duty cycle in order to achieve a target brightness (block 280). For instance, the target brightness may correspond to a maximum FOS brightness setting of the display 28. Decision logic 282 may determine whether an open circuit or multiple short circuit condition occurs on any one of the LED strings. For instance, as discussed above, the peak current feedback signal 150, voltage feedback signal 152, and current sink signal 154 for each LED string may be monitored by the backlight driver 120 to detect for the occurrence of an open or short circuit condition. If no open circuit or short circuit condition is detected, the process 278 returns from decision logic 282 to block 280. However, if such a condition is detected, then decision logic 282 proceeds to block 284, and the backlight driver 120 transitions to operate the remaining LED strings in non-redundant mode using PWM signals having a second duty cycle. As discussed above, the second duty cycle is greater than the first duty cycle due to the limiting of the maximum PWM duty cycle when operating in redundant mode.

As will be understood, the various techniques described above and relating to redundant and non-redundant backlight operation are provided herein by way of example only. Accordingly, it should be understood that the present disclosure should not be construed as being limited to only the examples provided above. Additionally, while the embodiments discussed depict pulse-width modulation dimming method as a driving technique for controlling the brightness of light sources of a backlight unit, other dimming techniques such as current amplitude modulation (e.g., linear dimming) or mix mode dimming (PWM+Linear) may also be implemented by a backlight driver to control the brightness of the light sources. Further, it should be appreciated that the backlight control techniques disclosed herein may be implemented in any suitable manner, including hardware (suitably configured circuitry), software (e.g., via a computer program including executable code stored on one or more tangible computer readable medium), or via using a combination of both hardware and software elements.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

controlling at least one light-emitting diode (LED) string of a backlight unit in a first mode, wherein the LED string comprises a plurality of LEDs electrically connected in series, such that all of the LEDs of the LED string are controlled to each provide a first light output, wherein the combined first light output from all of the LEDs provides a target luminance output for the LED string;

determining whether a shorted LED failure condition occurs in any of the LEDs in the LED string; and in response to detecting a shorted LED failure condition across at least one of the LEDs in the LED string, controlling at least one other LED string in a second mode to compensate for the shorted LED failure condition such that the remaining operational LEDs of the LED string are controlled to each provide the first light output, and LEDs of the at least one other LED string are each controlled to provide a second light output greater than the first light output, wherein the second light output of the LEDs of the at least one other LED string compensates for a difference between the target luminance output for the LED string and the combined first light output from the remaining operational LEDs of the LED string.

2. The method of claim 1, wherein backlight unit is configured to provide 1D scanning, and wherein the LED string and the other LED string are the only LED strings of the backlight unit.

3. The method of claim 1, wherein the backlight unit comprises a plurality of identically configured LED strings configured in an end-to-end series arrangement.

4. The method of claim 1, wherein, when controlling the LED strings in the first mode, the remaining operational LEDs on the LED string on which a shorted LED failure condition occurs are controlled to continue to provide the first light output, while the LEDs on all of the other LED strings on which a short circuit condition does not occur are controlled to provide the second light output.

5. The method of claim 1, wherein controlling the LED string in the first mode such that each of the LEDs provide the first light output comprises driving the LED string using first boost voltage generated by a first pulse-width modulation (PWM) signal having a first duty cycle, and wherein controlling the at least one other LED string in the second mode such that each of the LEDs of the at least one other LED string provide the second light output comprises driving the at least one other LED string using a second boost voltage generated by a second PWM signal having a second duty cycle, wherein the second duty cycle is greater than the first duty cycle.

6. The method of claim 1, wherein controlling the LED string in the first mode such that each of the LEDs provide the first light output comprises driving the LED string using a first current, and wherein controlling the at least one other LED string in the second mode such that each of the LEDs of the at least one other LED string provide the second light output comprises driving the at least one other LED string using a second current, wherein the second current is greater than the first current.

7. The method of claim 1, wherein determining whether a short circuit condition occurs in the LED string comprises monitoring at least one of a voltage feedback signal, a current sink signal, and a temperature reading provided by the LED string.

8. A method comprising:

controlling a plurality of light-emitting diode (LED) strings of an edge-lit backlight unit in a redundant mode, wherein the plurality of LED strings are configured in an interleaved arrangement along an edge of the backlight unit, by driving each of the LED strings at a first driving strength such that each LED within each LED string outputs a first quantity of light in the redundant mode and such that the combined light output from each LED string corresponds to a target luminance output of the backlight unit;

detecting the occurrence of a short circuit condition in one of the LED strings;

controlling the plurality of LED strings in a non-redundant mode in response to detecting the short circuit condition by identifying a first LED string containing an LED that is directly adjacent to an LED of the LED string with the short circuit condition, identifying a second LED string containing an LED that is directly adjacent to an LED of the LED string with the short circuit condition, driving the first and second LED strings at a second driving strength, and driving the remaining LED strings at the first driving strength, such that each LED of the first and second LED strings outputs a second quantity of light and each LED of each remaining LED string outputs the first quantity of light, wherein the combined light output from each LED string corresponds to the target luminance output of the backlight unit.

9. The method of claim 8, wherein the second quantity of light is greater than the first quantity of light.

10. The method of claim 8, wherein driving the LED strings at the first driving strength comprises using a first pulse-width modulation (PWM) signal having a first duty cycle and wherein driving the first and second LED strings at the second driving strength comprises using a second PWM signal having a second duty cycle that is greater than the first duty cycle.

11. The method of claim 8, wherein detecting the occurrence of the short circuit condition comprises receiving a feedback signal from each of the plurality of LED strings and comparing the respective feedback signals from the LED strings against each other.

12. A method comprising:

providing a plurality of light-emitting diodes (LEDs) arranged in independently controllable LED strings;

configuring the LED strings in an end-to-end arrangement along an edge of a backlight unit, wherein each LED string comprises a total number of LEDs including a first set of LEDs corresponding to a minimum number of LEDs for achieving a target light output from the LED string and a second set of at least one redundant LED;

determining a first duty cycle for a pulse-width modulation (PWM) signal used to cause each of the LED strings to provide the target light output when controlled in a redundant mode, wherein all of the LEDs of each LED string are functional in the redundant mode, and wherein the first duty cycle is determined as a ratio of the number of LEDs in the first set to the total number of LEDs;

determining a second duty cycle for a pulse-width modulation signal used to cause an LED string with a short circuit condition to provide the same target light output when controlled in a non-redundant mode in which at least one LED of the LED string is non-functional due to the short circuit condition, and wherein the second duty cycle is determined as a ratio of the number of LEDs in the first set to a number of remaining functional LEDs in the LED string.

13. The method of claim 12, comprising:

providing a backlight driver circuit and configuring the backlight driver circuit to control the LED strings using the first duty cycle when no short circuit conditions are present and to control the LED string with the short circuit condition using the second duty cycle when when a short circuit condition is present in one of the LED strings.

14. A display device comprising:

a liquid crystal display (LCD) panel;

a backlight configured to provide light to the LCD panel, wherein the backlight comprises a plurality of light-emitting diodes (LEDs) arranged in independently controllable groups, wherein each of the independently controllable groups comprises a plurality of LEDs; and a display controller comprising:

display driving circuitry configured to provide image signals and scanning signals to the LCD panel; and a backlight driver configured to control each independently controllable group of LEDs in a first manner to provide a target luminous flux output from the backlight when no short circuit conditions are present in any of the independently controllable groups of LED, and if a short circuit condition is detected in one of the independently controllable groups of LEDs, driving the independently controllable group of LEDs having the short circuit condition in a first manner while driving the remaining independently controllable groups of LEDs without a short circuit condition in the second manner to provide the same target luminous flux output from the backlight.

15. The method of claim 14, comprising configuring the backlight driver circuit such that the LED strings without a short circuit condition continue to be controlled using the first duty cycle in the non-redundant mode.

16. The display device of claim 14, wherein the backlight comprises an edge-lit backlight, and wherein the independently controllable groups of LEDs are configured in an end-to-end series arrangement along an edge of the backlight.

17. The display device of claim 14, wherein the backlight driver comprises a pulse-width modulation (PWM) signal generator, and wherein driving an independently controllable group of LEDs in the first manner comprises using a PWM signal having a first duty cycle, and wherein driving an independently controllable group of LEDs in the second manner comprises using a PWM signal having a second duty cycle that is greater than the first duty cycle.

18. The display device of claim 14, wherein the backlight driver comprises boost converter circuitry, wherein the boost converter circuitry is configured to receive a voltage feedback signal and a peak current feedback signal, and wherein the backlight driver is configured to detect a short circuit condition by monitoring the states of the voltage feedback signal and the peak current feedback signal.

19. The display device of claim 14, wherein the backlight driver comprises current sink circuitry configured to receive a respect current sink signal from each of the independently controllable groups of LEDs, and wherein the backlight driver is configured to detect a short circuit condition by monitoring the states of the current sink signals.

20. The display device of claim 14, wherein the backlight driver comprises a temperature-sensing device configured to provide a temperature value associated with each of the independently controllable groups of LEDs, and wherein the backlight driver is configured to detect a short circuit condition by monitoring the temperature values.

21. The display device of claim 20, wherein the temperature-sensing device comprises a thermocouple or an external temperature sensor, or some combination thereof.

* * * * *